US010507666B2

(12) United States Patent
Yamane et al.

(10) Patent No.: US 10,507,666 B2
(45) Date of Patent: Dec. 17, 2019

(54) INK JET RECORDING APPARATUS AND METHOD OF PRODUCING POROUS BODY

(71) Applicant: CANON KABUSHIKI KAISHA, Tokyo (JP)

(72) Inventors: Toru Yamane, Yokohama (JP); Akihiro Mouri, Fuchu (JP); Noboru Toyama, Kawasaki (JP); Ryosuke Hirokawa, Kawasaki (JP); Kyosuke Deguchi, Yokohama (JP); Toru Ohnishi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/022,143

(22) Filed: Jun. 28, 2018

(65) Prior Publication Data

US 2018/0319166 A1 Nov. 8, 2018

Related U.S. Application Data

(63) Continuation of application No. PCT/JP2016/005247, filed on Dec. 28, 2016.

(30) Foreign Application Priority Data

Jan. 5, 2016 (JP) ..... 2016-000746
Jan. 29, 2016 (JP) ..... 2016-016272
(Continued)

(51) Int. Cl.
*B41F 31/24* (2006.01)
*B41L 27/26* (2006.01)
(Continued)

(52) U.S. Cl.
CPC ..... *B41J 2/2103* (2013.01); *B41F 31/24* (2013.01); *B41J 2/01* (2013.01); *B41L 27/26* (2013.01)

(58) Field of Classification Search
CPC ..... B41F 31/24; B41F 31/007; B41F 9/12; B41L 27/26; B41M 7/00; B41J 2/16517; B41J 2/2103; B41J 2/01
See application file for complete search history.

(56) References Cited

U.S. PATENT DOCUMENTS 5,841,456 A 11/1998 Takei et al.
6,916,081 B2 7/2005 Nakashima
(Continued)

FOREIGN PATENT DOCUMENTS

CN 1990241 A 7/2007
CN 101332708 A 12/2008
(Continued)

OTHER PUBLICATIONS

International Search Report in International Application No. PCT/JP2016/005247 (dated Mar. 2017).
(Continued)

*Primary Examiner* — Henok D Legesse
(74) *Attorney, Agent, or Firm* — Venable LLP

(57) ABSTRACT

An ink jet recording apparatus includes an image forming unit that forms a first image containing a first liquid and a coloring material on an ink receiving medium; and a liquid absorbing member that includes a porous body which is configured to be brought into contact with the first image so as to absorb at least a portion of the first liquid from the first image, in which the porous body is a porous sheet in which a first layer which is configured to be brought into contact
(Continued)

with the first image, a second layer including a second fiber and a third layer including a third fiber are laminated in this order.

29 Claims, 10 Drawing Sheets

(30) Foreign Application Priority Data

May 26, 2016 (JP) ..... 2016-105334
May 27, 2016 (JP) ..... 2016-106189

(51) Int. Cl.
*B41J 2/21* (2006.01)
*B41J 2/01* (2006.01)

(56) References Cited

U.S. PATENT DOCUMENTS

| | | | | |
|---|---|---|---|---|
| 7,129,284 | B2 | 10/2006 | Ma et al. | |
| 7,422,318 | B2 | 9/2008 | Kadomatsu et al. | |
| 7,481,526 | B2 | 1/2009 | Inoue | |
| 7,497,564 | B2 | 3/2009 | Yui | |
| 7,556,342 | B2 | 7/2009 | Hamano | |
| 7,594,722 | B2 | 9/2009 | Kadomatsu et al. | |
| 7,766,457 | B2 | 8/2010 | Chen | |
| 7,845,760 | B2 | 12/2010 | Hirakawa | |
| 7,926,933 | B2 | 4/2011 | Taniuchi et al. | |
| 8,226,225 | B2 * | 7/2012 | Yamanobe | B41J 2/0057 347/103 |
| 8,246,158 | B2 | 8/2012 | Ageishi et al. | |
| 8,857,962 | B2 | 10/2014 | Goto et al. | |
| 9,102,137 | B2 | 8/2015 | Koitabashi et al. | |
| 9,616,653 | B2 | 4/2017 | Liu | |
| 9,796,171 | B2 | 10/2017 | Liu | |
| 9,821,584 | B2 | 11/2017 | Noguchi et al. | |
| 10,029,481 | B2 | 7/2018 | Ohnishi et al. | |
| 2006/0055755 | A1 | 3/2006 | Yui et al. | |
| 2006/0061642 | A1 * | 3/2006 | Ueki | B41M 7/00 347/101 |
| 2006/0170752 | A1 * | 8/2006 | Kadomatsu | B41J 2/2114 347/105 |
| 2006/0214984 | A1 * | 9/2006 | Hirakawa | B41J 2/2114 347/31 |
| 2006/0221166 | A1 | 10/2006 | Inoue | |
| 2007/0229586 | A1 | 10/2007 | Hirakawa | |
| 2008/0055356 | A1 | 3/2008 | Yamanobe | |
| 2008/0236480 | A1 | 10/2008 | Furukawa et al. | |
| 2009/0079784 | A1 | 3/2009 | Chiwata et al. | |
| 2011/0069109 | A1 | 3/2011 | Tojo | |
| 2015/0306539 | A1 | 10/2015 | Yamato | |
| 2018/0297377 | A1 | 10/2018 | Ohnishi et al. | |
| 2018/0304616 | A1 | 10/2018 | Honda et al. | |
| 2018/0304617 | A1 | 10/2018 | Ohnishi et al. | |
| 2018/0311951 | A1 | 11/2018 | Sakamoto et al. | |
| 2018/0319179 | A1 | 11/2018 | Yamane et al. | |
| 2018/0319188 | A1 | 11/2018 | Toyama et al. | |
| 2018/0319189 | A1 | 11/2018 | Ohnishi et al. | |
| 2018/0319190 | A1 | 11/2018 | Hirokawa et al. | |
| 2018/0326719 | A1 | 11/2018 | Masuda et al. | |
| 2018/0326755 | A1 | 11/2018 | Ohnishi et al. | |

FOREIGN PATENT DOCUMENTS

| | | | |
|---|---|---|---|
| CN | 100546832 | C | 10/2009 |
| CN | 101607468 | A | 12/2009 |
| CN | 103660656 | A | 3/2014 |
| EP | 2 123 459 | A2 | 11/2009 |
| EP | 2 777 941 | A1 | 9/2014 |
| JP | 2000-103157 | A | 4/2000 |
| JP | 2001-171143 | A | 6/2001 |
| JP | 2001-179959 | A | 7/2001 |
| JP | 2004-43047 | A | 2/2004 |
| JP | 2004-181955 | A | 7/2004 |
| JP | 2005-161610 | A | 6/2005 |
| JP | 2006-82428 | A | 3/2006 |
| JP | 2006-088486 | A | 4/2006 |
| JP | 2006-102981 | A | 4/2006 |
| JP | 2006-205677 | A | 8/2006 |
| JP | 2006-264080 | A | 10/2006 |
| JP | 2007-268974 | A | 10/2007 |
| JP | 2007-268975 | A | 10/2007 |
| JP | 4016559 | B2 | 12/2007 |
| JP | 2008-055852 | A | 3/2008 |
| JP | 2008-087283 | A | 4/2008 |
| JP | 2008-213333 | A | 9/2008 |
| JP | 2008-246787 | A | 10/2008 |
| JP | 2009-000915 | A | 1/2009 |
| JP | 2009-000916 | A | 1/2009 |
| JP | 2009-045851 | A | 3/2009 |
| JP | 2009-61644 | A | 3/2009 |
| JP | 2009-061644 | A | 3/2009 |
| JP | 2009-072927 | A | 4/2009 |
| JP | 2009-086348 | A | 4/2009 |
| JP | 2009-159116 | A | 7/2009 |
| JP | 2009-166387 | A | 7/2009 |
| JP | 2009-214439 | A | 9/2009 |
| JP | 2009-226852 | A | 10/2009 |
| JP | 2009-234219 | A | 10/2009 |
| JP | 2010-201796 | A | 9/2010 |
| JP | 2011-63001 | A | 3/2011 |
| JP | 2011-245865 | A | 12/2011 |
| JP | 2012-116617 | A | 6/2012 |
| JP | 2012-183798 | A | 9/2012 |
| JP | 2013-10267 | A | 1/2013 |
| JP | 2014-193599 | A | 10/2014 |
| JP | 2015-16687 | A | 1/2015 |
| JP | 2015-96562 | A | 5/2015 |
| JP | 2015-098097 | A | 5/2015 |
| JP | 2015-145117 | A | 8/2015 |
| JP | 2015-150789 | A | 8/2015 |
| JP | 2015-208881 | A | 11/2015 |
| JP | 2016-120625 | A | 7/2016 |
| WO | 2015/034027 | A1 | 3/2015 |
| WO | 2017/119044 | A1 | 7/2017 |
| WO | 2017/119045 | A1 | 7/2017 |
| WO | 2017/119046 | A1 | 7/2017 |
| WO | 2017/119047 | A1 | 7/2017 |
| WO | 2017/119049 | A1 | 7/2017 |
| WO | 2018/105215 | A1 | 6/2018 |

OTHER PUBLICATIONS

Search Report and Written Opinion in Singapore Application No. 11201805829P (dated Sep. 17, 2018).
International Preliminary Report on Patentability in International Application No. PCT/JP2016/005247 (dated Jul. 2018).
U.S. Appl. No. 16/022,223, filed Jun. 28, 2018.
U.S. Appl. No. 16/022,118, filed Jun. 28, 2018.
U.S. Appl. No. 16/018,182, filed Jun. 26, 2018, Ohnishi et al.
U.S. Appl. No. 16/022,169, filed Jun. 28, 2018, Honda et al.
U.S. Appl. No. 16/022,189, filed Jun. 28, 2018, Ohnishi et al.
U.S. Appl. No. 16/013,276, filed Jun. 20, 2018, Ohnishi et al.
U.S. Appl. No. 16/019,905, filed Jun. 27, 2018, Torisaka et al.
U.S. Appl. No. 16/022,223, Patent WIPO Publication WO 2017/119046 A1.
U.S. Appl. No. 16/022,118, Patent WIPO Publication WO 2017/119044 A1.
U.S. Appl. No. 16/022,169, Patent WIPO Publication WO 2017/119047 A1.
U.S. Appl. No. 16/022,189, Patent WIPO Publication WO 2017/119049 A1.
First Office Action in Chinese Application No. 201680078027.X (dated Apr. 25, 2019).
First Office Action in Chinese Application No. 201680078100.3 (dated Apr. 25, 2019).
First Office Action in Chinese Application No. 201680078028.4 (dated Apr. 28, 2019).

(56) References Cited

OTHER PUBLICATIONS

First Office Action in Chinese Application No. 201680078084.8 (dated May 24, 2019).
Extended European Search Report in European Application No. 16883546.0 (dated Jul. 23, 2019).
Extended European Search Report in European Application No. 16883549.4 (dated Jul. 23, 2019).
Extended European Search Report in European Application No. 16883554.4 (dated Jul. 11, 2019).
Extended European Search Report in European Application No. 16883550.2 (dated Jul. 12, 2019).
Extended European Search Report in European Application No. 16883551.0 (dated Jul. 12, 2019).
Extended European Search Report in European Application No. 16883553.6 (dated Jul. 12, 2019).
Machine translation of JP 2008-213333 (Sep. 18, 2008).
Machine translation of JP 2009-061644 (Mar. 26, 2009).
Machine translation of 2015-098097 (May 28, 2015).
Machine translation of 2015-145117 (Aug. 13, 2018).

* cited by examiner

INK JET RECORDING APPARATUS AND METHOD OF PRODUCING POROUS BODY

CROSS-REFERENCE TO RELATED APPLICATIONS

This application is a Continuation of International Patent Application No. PCT/JP2016/005247, filed Dec. 28, 2016, which claims the benefit of Japanese Patent Application Nos. 2016-000746, filed Jan. 5, 2016, 2016-016272, filed Jan. 29, 2016, 2016-105334, filed May 26, 2016, and 2016-106189, filed May 27, 2016, all of which are hereby incorporated by reference herein in their entirety.

BACKGROUND OF THE INVENTION

Field of the Invention

The present invention relates to an ink jet recording apparatus and a method of producing a porous body used for the ink jet recording apparatus.

Description of the Related Art

In an ink jet recording method, an image is formed by directly or indirectly applying a liquid composition (ink) containing a coloring material onto a recording medium such as paper. At this time, curling and cockling may occur due to excessive absorption of a liquid component in ink by the recording medium.

Here, in order to rapidly remove the liquid component in the ink, a method of drying a recording medium using means such as warm air or infrared rays or a method of forming an image on a transfer body, then removing a liquid component contained in the image on the transfer body by thermal energy or the like, and then transferring the image onto the recording medium such as paper is provided.

Further, as means for removing the liquid component contained in the image on the transfer body, a method of absorbing and removing the liquid component from an ink image by bringing a roller-shaped porous body into contact with the ink image without using thermal energy has been proposed (Japanese Patent Application Laid-Open Nos. 2009-45851 and 2005-161610). Also, a method of absorbing and removing the liquid component from the ink image by bringing a belt-like polymeric absorber into contact with the ink image has been proposed (Japanese Patent Application Laid-Open No. 2001-179959).

SUMMARY OF THE INVENTION

However, in the methods disclosed in Japanese Patent Application Laid-Open Nos. 2009-45851, 2005-161610 and 2001-179959, at the time of absorbing and removing the liquid component from the ink image on the transfer body, so called "smeared image" in which a liquid, the coloring material, or a portion of solid content or the like other than the coloring material in the ink is swept to the rear end side of the image occurs. In addition, in a case where a member for absorbing and removing a liquid component is formed of a plurality of layers for the purpose of improving the absorbability of the liquid component, the interface between each layer may be peeled off when the member is conveyed. Accordingly, an object of the present invention is to provide an ink jet recording apparatus including a liquid absorbing member having suppressed smeared image and high conveying strength, and a method of producing a porous body used in the ink jet recording apparatus.

According to a first aspect of the present invention, there is provided an ink jet recording apparatus including an image forming unit that forms a first image containing a first liquid and a coloring material on an ink receiving medium; and a liquid absorbing member that includes a porous body which is configured to be brought into contact with the first image so as to absorb at least a portion of the first liquid from the first image, in which the porous body is a porous sheet in which a first layer which is configured to be brought into contact with the first image, a second layer including a second fiber and a third layer including a third fiber are laminated in this order, and the first layer, the second layer and the third layer are all the porous layers, an average fiber diameter of the second fiber is larger than an average fiber diameter of the third fiber, the second fiber has a core-in-sheath structure including a core structure forming a central axis and a sheath structure surrounding the core structure, a softening temperature of a material for forming the sheath structure is lower than any of a softening temperature of a material for forming the core structure, a softening temperature of a material for forming the first layer and a softening temperature of a material for forming the third fiber, and an average thickness of the sheath structure is smaller than a thickness of the first layer.

According to a second aspect of the present invention, there is provided an ink jet recording apparatus including an image forming unit that forms a first image containing a first liquid and a coloring material on an ink receiving medium; and a liquid absorbing member that includes a porous body which is configured to be brought into contact with the first image so as to absorb at least a portion of the first liquid from the first image, in which the porous body is a porous sheet in which a first layer which is configured to be brought into contact with the first image, a second layer a including a second fiber a, a second layer b including a second fiber b and a third layer including a third fiber are laminated in this order, and the first layer, the second layer a, the second layer b and the third layer are all porous layers, an average fiber diameter of the second fiber b is larger than an average fiber diameter of the third fiber, the second fiber a and the second fiber b have a core-in-sheath structure including a core structure forming a central axis and a sheath structure surrounding the core structure, a softening temperature of a material for forming the sheath structure of the second fiber a is lower than any of a softening temperature of a material for forming the core structure of the second fiber a and a softening temperature of a material for forming the first layer, a softening temperature of a material for forming the sheath structure of the second fiber b is lower than any of a softening temperature of a material for forming the core structure of the second fiber b and a softening temperature of a material for forming the third fiber, and an average thickness of the sheath structure of the second fiber a is smaller than a thickness of the first layer.

According to a third aspect of the present invention, there is provided an ink jet recording apparatus including an image forming unit that forms a first image on an ink receiving medium by applying ink containing a first liquid and a coloring material; and a liquid absorbing member that includes a porous body which is configured to be brought into contact with the first image so as to concentrate ink constituting the first image, in which the porous body is a porous sheet in which a first layer which is configured to be brought into contact with the first image, a second layer including a second fiber and a third layer including a third fiber are laminated in this order, and the first layer, the second layer and the third layer are all porous layers, an average fiber diameter of the second fiber is larger than an average fiber diameter of the third fiber, the second fiber has a core-in-sheath structure including a core structure forming a central axis and a sheath structure surrounding the core structure, a softening temperature of a material for forming the sheath structure is lower than any of a softening temperature of a material for forming the core structure, a softening temperature of a material for forming the first layer and a softening temperature of a material for forming the third fiber, and an average thickness of the sheath structure is smaller than a thickness of the first layer.

According to a fourth aspect of the present invention, there is provided a method of producing a porous body used in an ink jet recording apparatus including an image forming unit that forms a first image containing a first liquid and a coloring material on an ink receiving medium; and a liquid absorbing member that includes a porous body which is configured to be brought into contact with the first image so as to absorb at least a portion of the first liquid from the first image, the method including a step of heating a first layer which is configured to be brought into contact with the first image, a second layer including a second fiber and a third layer including a third fiber in a state of being laminated in this order so as to form a porous body including the first layer, the second layer and the third layer, in which the first layer, the second layer and the third layer are all porous layers, an average fiber diameter of the second fiber is larger than an average fiber diameter of the third fiber, the second fiber has a core-in-sheath structure including a core structure forming a central axis and a sheath structure surrounding the core structure, a softening temperature of a material for forming the sheath structure is lower than any of a softening temperature of a material for forming the core structure, a softening temperature of a material for forming the first layer and a softening temperature of a material for forming the third fiber, an average thickness of the sheath structure is smaller than a thickness of the first layer, and a temperature of the heating is equal to or higher than the softening temperature of the material for forming the sheath structure, and is lower than the softening temperature of the material for forming the core structure, the softening temperature of the material for forming the first layer and the softening temperature of the material for forming the third fiber.

According to a fifth aspect of the present invention, there is provided a method of producing a porous body used in an ink jet recording apparatus including an image forming unit that forms a first image containing a first liquid and a coloring material on an ink receiving medium; and a liquid absorbing member that includes a porous body which is configured to be brought into contact with the first image so as to absorb at least a portion of the first liquid from the first image, the method including a step of heating a first layer which is configured to be brought into contact with the first image, a second layer a including a second fiber a, a second layer b including a second fiber b and a third layer including the third fiber in a state of being laminated in this order so as to form a porous body including the first layer, the second layer a, the second layer b and the third layer, in which the first layer, the second layer a, the second layer b and the third layer are all porous layers, an average fiber diameter of the second fiber b is larger than an average fiber diameter of the third fiber, the second fiber a and the second fiber b have a core-in-sheath structure including a core structure forming a central axis and a sheath structure surrounding the core structure, a softening temperature of a material for forming the sheath structure of the second fiber a is lower than any of a softening temperature of a material for forming the core structure of the second fiber a and a softening temperature of a material for forming the first layer, a softening temperature of a material for forming the sheath structure of the second fiber b is lower than any of a softening temperature of a material for forming the core structure of the second fiber b and a softening temperature of a material for forming the third fiber, an average thickness of the sheath structure of the second fiber a is smaller than a thickness of the first layer, and a temperature of the heating is equal to or higher than the softening temperature of the material for forming the sheath structure of the second fiber a and the second fiber b, and is equal to or lower than the softening temperature of the material for forming the core structure of the second fiber a and the second fiber b, the softening temperature of the material for forming the first layer, and the softening temperature of the material for forming the third fiber.

Further features of the present invention will become apparent from the following description of exemplary embodiments with reference to the attached drawings.

DESCRIPTION OF THE EMBODIMENTS

Figure 1:
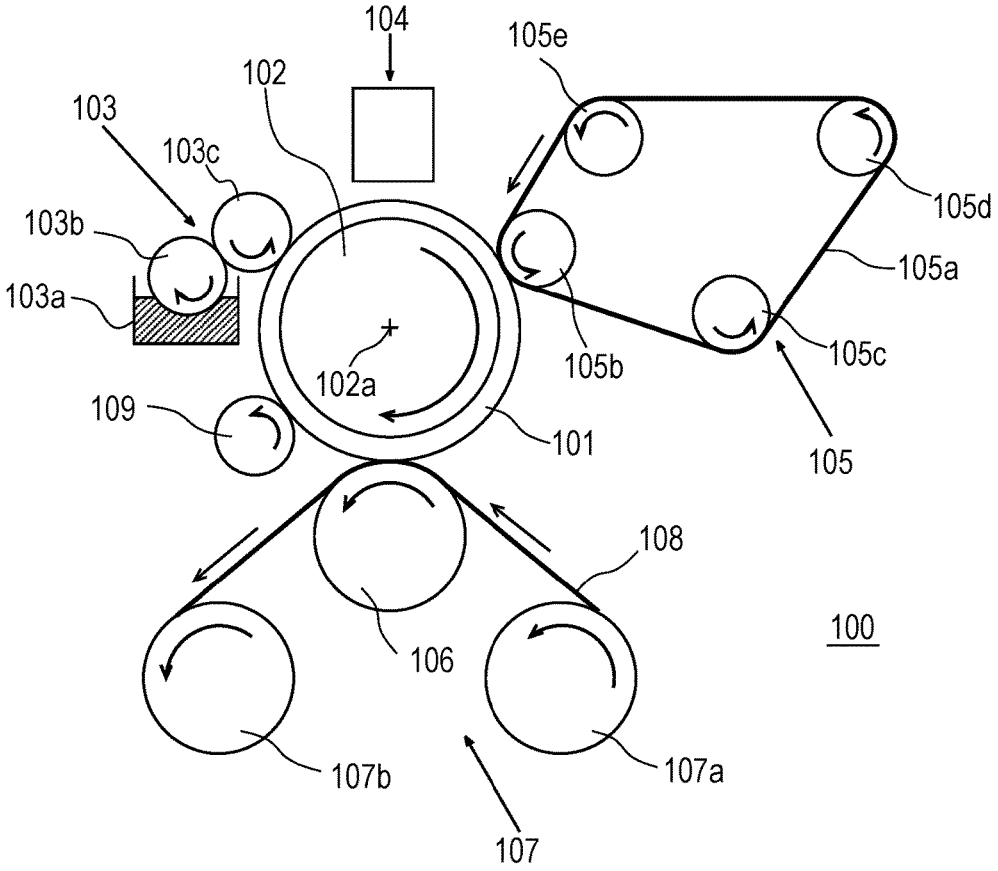
FIG. 1 is a schematic diagram illustrating one example of a configuration of a transfer type ink jet recording apparatus in one embodiment according to the present invention.

Hereinafter, the present invention will be described in detail with reference to preferred embodiments.

An ink jet recording apparatus of the present invention includes an image forming unit that forms a first image containing a first liquid and a coloring material on an ink receiving medium; and a liquid absorbing member that includes a porous body which is configured to be brought into contact with the first image so as to absorb at least a portion of the first liquid from the first image. When the liquid absorbing member including the porous body is brought into contact with the first image on the ink receiving medium which contains the first liquid and the coloring material, at least a portion of the first liquid is removed from the first image. As a result, curling and cockling caused by excessive absorption of the first liquid in the first image by the recording medium such as paper are suppressed. It is not necessary to absorb all of the first liquid.

In the ink jet recording apparatus of the present invention, the porous body is a porous sheet in which a first layer which is configured to be brought into contact with the first image, a second layer including a second fiber and a third layer including a third fiber are laminated in this order, and the first layer, the second layer and the third layer are all porous layers. An average fiber diameter of the second fiber is larger than an average fiber diameter of the third fiber. The second fiber has a core-in-sheath structure including a core structure forming a central axis and a sheath structure surrounding the core structure. A softening temperature of a material for forming the sheath structure is lower than any of a softening temperature of a material for forming the core structure, a softening temperature of a material for forming the first layer and a softening temperature of a material for forming the third fiber. An average thickness of the sheath structure is smaller than a thickness of the first layer. By satisfying these requirements, the first and the second layers are prevented from being collapsed, and the adhesive strength between the second layer and the third layer is enhanced, and thereby, it is presumed that it is possible to provide an ink jet recording apparatus including a liquid absorbing member having suppressed smeared image and high conveying strength.

In addition, in another ink jet recording apparatus of the present invention, the porous body is a porous sheet in which a first layer which is configured to be brought into contact with the first image, a second layer a including a second fiber a, a second layer b including a second fiber b and a third layer including a third fiber are laminated in this order, and the first layer, the second layer a, the second layer b and the third layer are all porous layers. An average fiber diameter of the second fiber b is larger than an average fiber diameter of the third fiber. The second fiber a and the second fiber b have a core-in-sheath structure including a core structure forming a central axis and a sheath structure surrounding the core structure. A softening temperature of a material for forming the sheath structure of the second fiber a is lower than any of a softening temperature of a material for forming the core structure of the second fiber a and a softening temperature of a material for forming the first layer. A softening temperature of a material for forming the sheath structure of the second fiber b is lower than any of a softening temperature of a material for forming the core structure of the second fiber b and a softening temperature of a material for forming the third fiber. An average thickness of the sheath structure of the second fiber a is smaller than a thickness of the first layer. By satisfying these requirements, the above effect can be obtained, and at the same time, it is possible to easily achieve the prevention of the collapse of the first layer and enhancement of the adhesive strength between the second layer and the third layer while suppressing the irregularities of the surface on the first layer side of the second layer. As a result, it is presumed that it is possible to provide an ink jet recording apparatus including a liquid absorbing member having suppressed smeared image and high conveying strength.

A method of producing porous a body used in the ink jet recording apparatus of the present invention includes a step of heating a first layer which is configured to be brought into contact with the first image, a second layer including a second fiber and a third layer including a third fiber in a state of being laminated in this order so as to form a porous body including the first layer, the second layer and the third layer. In addition, the first layer, the second layer and the third layer are all porous layers. A temperature of the heating is equal to or higher than the softening temperature of the material for forming the sheath structure, and is equal to or lower than the softening temperature of the material for forming the core structure, the softening temperature of the material for forming the first layer and the softening temperature of the material for forming the third fiber. According to this method, the ink jet recording apparatus of the present invention can be suitably manufactured.

A method of producing a porous body used in another ink jet recording apparatus in the present invention includes a step of producing a porous body in which a first layer which is configured to be brought into contact with the first image, a second layer a including a second fiber a, a second layer b including a second fiber b and a third layer including a third fiber are laminated in this order by heating. In addition, the first layer, the second layer a, the second layer b and the third layer are all porous layers. A temperature of the heating is equal to or higher than the softening temperature of the material for forming the sheath structure of the second fiber a and the second fiber b, and is equal to or lower than the softening temperature of the material for forming the core structure of the second fiber a and the second fiber b, the softening temperature of the material for forming the first layer and the softening temperature of the material for forming the third fiber. According to this method, another ink jet recording apparatus of the present invention can be suitably manufactured.

In the ink jet recording apparatus of the present invention, the image forming unit is not particularly limited as long as it can form a first image containing the first liquid and the coloring material on the ink receiving medium. The image forming unit preferably includes 1) a device for applying a first liquid composition containing the first liquid or a second liquid, and an ink viscosity-increasing component onto the ink receiving medium; and 2) a device for applying a second liquid composition containing the first liquid or the second liquid, and the coloring material onto the ink receiving medium, and forms the first image as a mixture of the first and second liquid compositions. In general, the second liquid composition is ink containing the coloring material, and the device for applying the second liquid composition onto the ink receiving medium is an ink jet recording device. In addition, the first liquid composition contains a component (ink viscosity-increasing component) which chemically or physically acts with the second liquid composition to thereby viscously thicken a mixture of the first and second liquid compositions more than each of the first and second liquid compositions. At least one of the first and the second liquid compositions includes the first liquid. Here, the first liquid includes a liquid having low volatility at normal temperature (room temperature), and particularly includes water. The second liquid is a liquid other than the first liquid, and although it does not matter whether the volatility is high or low, it is preferably a liquid having higher volatility than that of the first liquid. Note that, the arrangement of the device for applying the first liquid composition to the ink receiving medium and the device for applying the second liquid composition to the ink receiving medium is not particularly limited, but from the viewpoint of realizing the high quality of the image, it is preferable that the step of applying the first liquid composition to the ink receiving medium and the step of applying the second liquid composition to the ink receiving medium such that at least a portion of the applied second liquid composition overlaps with a region to which the first liquid composition is applied are performed in this order. For this reason, it is preferably that the device for applying the first liquid composition to the ink receiving medium and the device for applying the second liquid composition to the ink receiving medium are disposed so as to be able to apply the first liquid composition onto the ink receiving medium, and to apply the second liquid composition such that at least a portion of the applied second liquid composition and a region to which the first liquid composition is applied overlap. Hereinafter, the first liquid composition is referred to as a "reaction liquid", and the device for applying the first liquid composition onto the ink receiving medium is referred to as a "reaction liquid applying device". Further, the second liquid composition is referred to as "ink", and the device for applying the second liquid composition onto the ink receiving medium is referred to as an "ink applying device". In addition, the first image is an ink image before liquid removal before being subjected to liquid absorption treatment by the liquid absorbing member. An ink image after liquid removal in which the content of the first liquid is reduced by performing the liquid absorption treatment is referred to as a second image. In the following description, as a pretreatment to the porous body used for the liquid absorbing member, a process of preliminarily wetting the porous body with the wetting liquid will be described.

<Reaction Liquid Applying Device>

The reaction liquid applying device may be any device as long as the reaction liquid can be applied onto the ink receiving medium, and various known devices can be appropriately used. Specifically, examples thereof include a gravure offset roller, an ink jet head, a die coating device (die coater) and a blade coating device (blade coater). The application of the reaction liquid by the reaction liquid applying device may be performed before application of the ink or after application of the ink as long as the reaction liquid on the ink receiving medium can be mixed (reacted) with the ink. The reaction liquid is preferably applied before the application of the ink. When the reaction liquid is applied before the application of the ink, it is also possible to suppress bleeding in which adjacently applied inks are mixed with each other or beading in which the previously landed ink is attracted to the ink landed later at the time of image recording by an ink jet method.

<Reaction Liquid>

The reaction liquid contains a component that increases the viscosity of the ink (ink viscosity-increasing component). Here, a viscosity increase of an ink means that a coloring material, a resin or the like which is a component constituting the ink chemically reacts by contact with an ink viscosity-increasing component, or physically adsorbs the ink viscosity-increasing component, and as a result, an increase in the viscosity of the ink is observed. The viscosity increase of an ink includes not only the case where the increase in the ink viscosity is observed, but also a case where a portion of the component constituting the ink such as the coloring material and the resin aggregates so that the viscosity is locally increased. The ink viscosity-increasing component has an effect of reducing the fluidity of a portion of the ink and/or the component constituting the ink on the ink receiving medium so as to suppress bleeding and beading during the first image formation. In the present invention, the increasing of the viscosity of the ink is also referred to as "viscously thickening the ink". Known materials such as a polyvalent metal ion, organic acid, a cationic polymer and a porous fine particle can be used as such an ink viscosity-increasing component. Among these, the polyvalent metal ion and the organic acid are particularly preferable. In addition, it is also preferable to include plural kinds of the ink viscosity-increasing components. Note that, the content of the ink viscosity-increasing component in the reaction liquid is preferably 5% by mass or more with respect to the total mass of the reaction liquid.

Examples of the polyvalent metal ion include divalent metal ions such as $Ca^{2+}$, $Cu^{2+}$, $Ni^{2+}$, $Mg^{2+}$, $Sr^{2+}$, $Ba^{2+}$ and $Zn^{2+}$, and trivalent metal ions such as $Fe^{3+}$, $Cr^{3+}$, $Y^{3+}$ and $Al^{3+}$.

Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furancarboxylic acid, pyridine carboxylic acid, coumaric acid, thiophene carboxylic acid, nicotinic acid, oxysuccinic acid and dioxsuccinic acid.

The reaction liquid may contain water or an organic solvent of low volatility in an appropriate amount as the first liquid. Water used in this case is preferably deionized water by ion exchange or the like. The organic solvent that can be used in the reaction liquid applied to the present invention is not particularly limited, and known organic solvents can be used.

The reaction liquid can be used by appropriately adjusting the surface tension and the viscosity by adding a surfactant or a viscosity adjusting agent. The material to be used is not particularly limited as long as it can coexist with the ink viscosity-increasing component. Specific examples of the surfactant to be used include acetylene glycol ethylene oxide adduct ("Acetylenol E100" (product name), manufactured by Kawaken Fine Chemicals Co., Ltd.) and perfluoroalkyl ethylene oxide adduct ("Megafac F444" (product name), manufactured by DIC Corporation).

<Ink Applying Device>

An ink jet head is used as an ink applying device for applying ink. Examples of the ink jet head include a form in which ink is discharged by causing film boiling in the ink by an electro-thermal converter so as to form bubbles, a form in which ink is discharged by an electro-mechanical converter and a form in which ink is discharged by using static electricity. In the present invention, a known ink jet head can be used. Particularly, from the viewpoint of high-speed and high-density printing, one utilizing an electro-thermal converter is suitably used. Drawing is performed by receiving an image signal and applying a necessary amount of ink to each position.

An ink applying amount can be expressed by the image density (duty) or the ink thickness; however, in the present invention, an average value obtained by multiplying the mass of each of the ink dots by the number of ink dots to be applied and dividing by the printing area was set as the ink applying amount ($g/m^2$). Note that, from the viewpoint of removing the liquid component in the ink, the maximum ink applying amount in the image region indicates an ink applying amount in an area of at least 5 $mm^2$ or larger in a region used as information of the ink receiving medium.

The ink jet recording apparatus of the present invention may include a plurality of ink jet heads for applying various colors of ink onto the ink receiving medium. For example, in a case of forming respective color images using yellow ink, magenta ink, cyan ink and black ink, the ink jet recording apparatus includes four ink jet heads that discharge each of the above four kinds of ink onto an ink receiving medium.

In addition, the ink applying device may include an ink jet head that discharges ink (clear ink) which does not contain a coloring material.

<Ink>

Each component of the ink applied to the present invention will be described.

(Coloring Material)

The coloring material contained in the ink applied to the present invention preferably includes a pigment. For example, it is preferable to use a pigment or a mixture of a dye and the pigment as a coloring material. The kinds of the pigments which can be used as a coloring material are not particularly limited. Specific examples of the pigment include an inorganic pigment such as carbon black; and an organic pigment such as an azo-based organic pigment, a phthalocyanine-based organic pigment, a quinacridone-based organic pigment, an isoindolinone-based organic pigment, an imidazolone-based organic pigment, a diketopyrrolopyrrole-based organic pigment and a dioxazine-based organic pigment. These pigments may be used alone or if necessary, two or more kinds thereof may be used in combination.

The kinds of the dyes which can be used as a coloring material are not particularly limited. Specific examples of the dye include direct dyes, acidic dyes, basic dyes, disperse dyes, edible dyes and the like, and dyes having anionic groups can be used. Specific examples of the dye skeleton include an azo skeleton, a triphenylmethane skeleton, a phthalocyanine skeleton, an azaphthalocyanine skeleton, a xanthene skeleton and an anthrapyridone skeleton.

The content of the pigment in the ink is preferably 0.5% by mass or more to 15.0% by mass or less, and is more preferably 1.0% by mass or more to 10.0% by mass or less with respect to the total mass of the ink.

(Dispersant)

As a dispersant for dispersing the pigment, a known dispersant used for ink jet ink can be used. In the embodiment of the present invention, it is particularly preferable to use a water-soluble dispersant having both a hydrophilic portion and a hydrophobic portion in the structure thereof. In particular, a pigment dispersant containing a resin obtained by copolymerizing at least a hydrophilic monomer and a hydrophobic monomer is preferably used. The monomers used here are not particularly limited, and known monomers are preferably used. Specific examples of the hydrophobic monomer include styrene and other styrene derivatives, alkyl (meth)acrylate and benzyl (meth)acrylate. Examples of the hydrophilic monomer include acrylic acid, methacrylic acid and maleic acid.

The acid value of the dispersant is preferably 50 mgKOH/g or more to 550 mgKOH/g or less. In addition, a weight average molecular weight of the dispersant is preferably 1,000 or more to 50,000 or less. Note that, a mass ratio (pigment:dispersant) of the pigment to the dispersant is preferably in a range of 1:0.1 to 1:3.

In the present invention, it is also preferable to use a so-called self-dispersible pigment in which the pigment itself is surface-modified so that it can be dispersed without using a dispersant.

(Resin Fine Particle)

The ink applied to the present invention can contain various fine particles which do not contain coloring materials. Among these, the resin fine particle is effective in improving image quality and fixing property in some cases, and thus is preferable.

The materials of the resin fine particles that can be used in the present invention are not particularly limited, and known resins can be appropriately used. Specific examples thereof include a homopolymer such as polyolefin, polystyrene, polyurethane, polyester, polyether, polyurea, polyamide, polyvinyl alcohol, poly (meth)acrylic acid and salts thereof, alkyl poly (meth)acrylate and polydiene, or a copolymer obtained by polymerizing a combination of a plurality of monomers for producing these homopolymers. The weight average molecular weight of the resin (Mw) is preferably 1,000 or more to 2,000,000 or less. The amount of the resin fine particles in the ink is preferably 1% by mass or more to 50% by mass or less, and is more preferably 2% by mass or more to 40% by mass or less, with respect to the total mass of the ink.

Further, in the embodiment of the present invention, it is preferable to use the resin fine particle dispersion in which the resin fine particles are dispersed in a liquid. The method of dispersion is not particularly limited, and a so-called self-dispersible type resin fine particle dispersion in which the resin fine particles are dispersed using a resin obtained by homopolymerizing a monomer having a dissociable group or copolymerizing a plurality of kinds of monomers is suitable. Here, examples of the dissociable group include a carboxyl group, a sulfonic acid group and a phosphoric acid group, and examples of the monomer having such a dissociable group include acrylic acid and methacrylic acid. In addition, a so-called emulsion dispersion type resin fine particle dispersion in which the resin fine particles are dispersed with an emulsifier can likewise be suitably used in the present invention. A known surfactant is preferable as the emulsifier, regardless of low molecular weight and high molecular weight. The surfactant is preferably a nonionic surfactant or a surfactant which has the same electron as that of the resin fine particle.

The resin fine particle dispersion used in the embodiment of the present invention preferably has a dispersed particle diameter of 10 nm or more to 1,000 nm or less, and more preferably has a dispersed particle diameter of 50 nm or more to 500 nm or less, and still more preferably has a dispersed particle diameter of 100 nm or more to 500 nm or less.

In addition, when the resin fine particle dispersion used in the embodiment of the present invention is prepared, it is also preferable to add various additives for stabilization. Examples of such additives include n-hexadecane, dodecyl methacrylate, stearyl methacrylate, chlorobenzene, dodecyl mercaptan, blue dye (bluing agent) and polymethyl methacrylate.

(Curing Component)

In the present invention, it is preferable that a component that is cured by active energy rays is contained in either the reaction liquid or the ink. By curing the component to be cured by the active energy rays before the liquid absorbing step, the coloring material adhesion to the liquid absorbing member may be suppressed in some cases.

As a component to be cured by being irradiated with the active energy rays used in the present invention, a component that is cured by being irradiated with the active energy rays and increases its insolubility than that of before irradiation is used. As an example, a general ultraviolet curable resin can be used. Many of the ultraviolet curable resins are insoluble in water, but as a material that can be applied to the water-based ink suitably used in the present invention, a material having at least an ethylenically unsaturated bond curable with ultraviolet rays in the structure thereof and having a hydrophilic bonding group is preferable. Examples of the bonding group for having hydrophilicity include a hydroxyl group, a carboxyl group, a phosphoric acid group, a sulfonic acid group and salts thereof, an ether bond and an amide bond. In addition, the component, which is to be cured, and used in the present invention is preferably hydrophilic.

Further, examples of the active energy rays include ultraviolet rays, infrared rays and electron beams.

In the present invention, it is preferable that a polymerization initiator is contained in either the reaction liquid or the ink. The polymerization initiator used in the present invention may be any compound as long as it generates radicals by active energy rays.

Further, in order to improve the reaction rate, it is one of extremely preferable embodiments to use a sensitizer having a role of widening the light absorption wavelength in combination.

(Surfactant)

The ink that can be used in the present invention may contain a surfactant. Specific examples of the surfactant include acetylene glycol ethylene oxide adduct (Acetylenol E100 (product name), manufactured by Kawaken Fine Chemicals Co., Ltd.) and the like. The amount of the surfactant in the ink is preferably 0.01% by mass or more to 5.0% by mass or less with respect to the total mass of the ink.

(Water and Water-Soluble Organic Solvent)

The ink used in the present invention may contain water and/or a water-soluble organic solvent as a solvent. Water is preferably deionized water by ion exchange or the like. In addition, the content of the water in the ink is preferably 30% by mass or more to 97% by mass or less with respect to the total mass of the ink, and is more preferably 50% by mass or more to 95% by mass or less with respect to the total mass of the ink.

Further, the kinds of the water-soluble organic solvent to be used are not particularly limited, and any of known organic solvents can be used. Specific examples thereof include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol and methanol. Of course, it is also possible to mix and use two or more kinds selected from them.

In addition, the amount of the water-soluble organic solvent in the ink is preferably 3% by mass or more to 70% by mass or less with respect to the total mass of the ink.

(Other Additives)

In addition to the above components, as necessary, the ink that can be used in the present invention may contain other additives such as a pH adjuster, a rust preventive, an antiseptic, a mildewproofing agent, an antioxidant, a reducing agent, a water soluble resin and its neutralizing agent, a viscosity modifier and the like.

<Liquid Absorbing Member>

In the present invention, when at least a portion of the first liquid is absorbed from the first image by being brought into contact with the liquid absorbing member having the porous body, the content of the liquid component in the first image is decreased. The contact surface of the liquid absorbing member with the first image is set as the first surface, and the porous body is disposed on the first surface. The liquid absorbing member containing such a porous body preferably has a shape which is capable of circulating so as to absorb the liquid by moving in conjunction with the movement of the ink receiving medium to come into contact with the first image, and then coming again in contact with another first image at a predetermined cycle. For example, an endless belt shape or a drum shape can be exemplified.

(Porous Body)

Hereinafter, the first embodiment and the second embodiment of the porous body will be described. In the present invention, the porous body may be any material as long as it has a large number of pores, and, for example, a material having many pores formed by the intersection of the fibers is also included in the porous body of the present invention.

First Embodiment

The porous body of the present embodiment is a porous sheet in which a first layer which is brought into contact with a first image, a second layer including a second fiber, and a third layer including a third fiber are laminated in this order, and satisfies the following requirements (1) to (4). (1) An average fiber diameter of the second fiber is larger than an average fiber diameter of the third fiber. (2) The second fiber has a core-in-sheath structure including a core structure forming the central axis and a sheath structure surrounding the core structure. (3) A softening temperature of a material for forming the sheath structure is lower than any of a softening temperature of a material for forming the core structure, a softening temperature of a material for forming the first layer and a softening temperature of a material for forming the third fiber. (4) An average thickness of the sheath structure is smaller than a thickness of the first layer.

The inventors of the present invention have examined that the porous body disclosed in Japanese Patent Application Laid-Open Nos. 2009-45851, 2005-161610 and 2001-179959 is used as a porous body in the liquid absorbing member of the ink jet recording apparatus. As a result, when a plurality of layers are laminated, it has been found that smeared image occurs due to the degree of adhesion between the layers or there is a problem that the conveying strength of the liquid absorbing member is insufficient at the time of conveyance.

As a result of detailed examination by the inventors of the present invention, as to the smeared image, it has been found that when the first layer, the second layer which adheres the first layer and the third layer, and the third layer are laminated and heated, as the melting of the second layer proceeds, collapse occurs in the first layer and the second layer, and thereby the smeared image occurs. In contrast, the inventors of the present invention have found that it is possible to prevent the first layer and the second layer from being collapsed by employing the configurations of (2) to (4). That is, the second layer includes the second fiber having the core-in-sheath structure of the core structure forming the central axis and the sheath structure surrounding the core structure. In addition, the softening temperature of the material for forming the sheath structure is lower than any of the softening temperature of the material for forming the core structure, the softening temperature of the material for forming the first layer and the softening temperature of the material for forming the third fiber. At this time, by heating and laminating under the condition that only the material for forming the sheath structure is softened, core structures are not melted with each other, and the entire of the second layer is not melted and collapsed in the heating step, and thereby it is possible to prevent the second layer from being collapsed. Further, the average thickness of the sheath structure is smaller than the thickness of the first layer, and thereby it is possible to prevent the first layer from being collapsed. When it is possible to prevent the first and the second layers from being collapsed, the flow resistance inside the porous body can be kept low, and thereby the smeared image is suppressed.

Further, as to the conveying strength, the inventors of the present invention have found that the adhesiveness between the second layer and the third layer is improved, and the conveying strength is increased by employing the configuration of the above (1). That is, when the third layer includes the third fiber, if the average fiber diameter of the second fiber is larger than the average fiber diameter of the third fiber, at the time when only the material for forming the sheath structure is softened, the second fiber of the second layer is interposed between the third fibers of the third layer and thereby an anchor effect occurs. With this, the adhesive strength between the second layer and the third layer is enhanced, and the conveying strength is enhanced.

Figure 6:
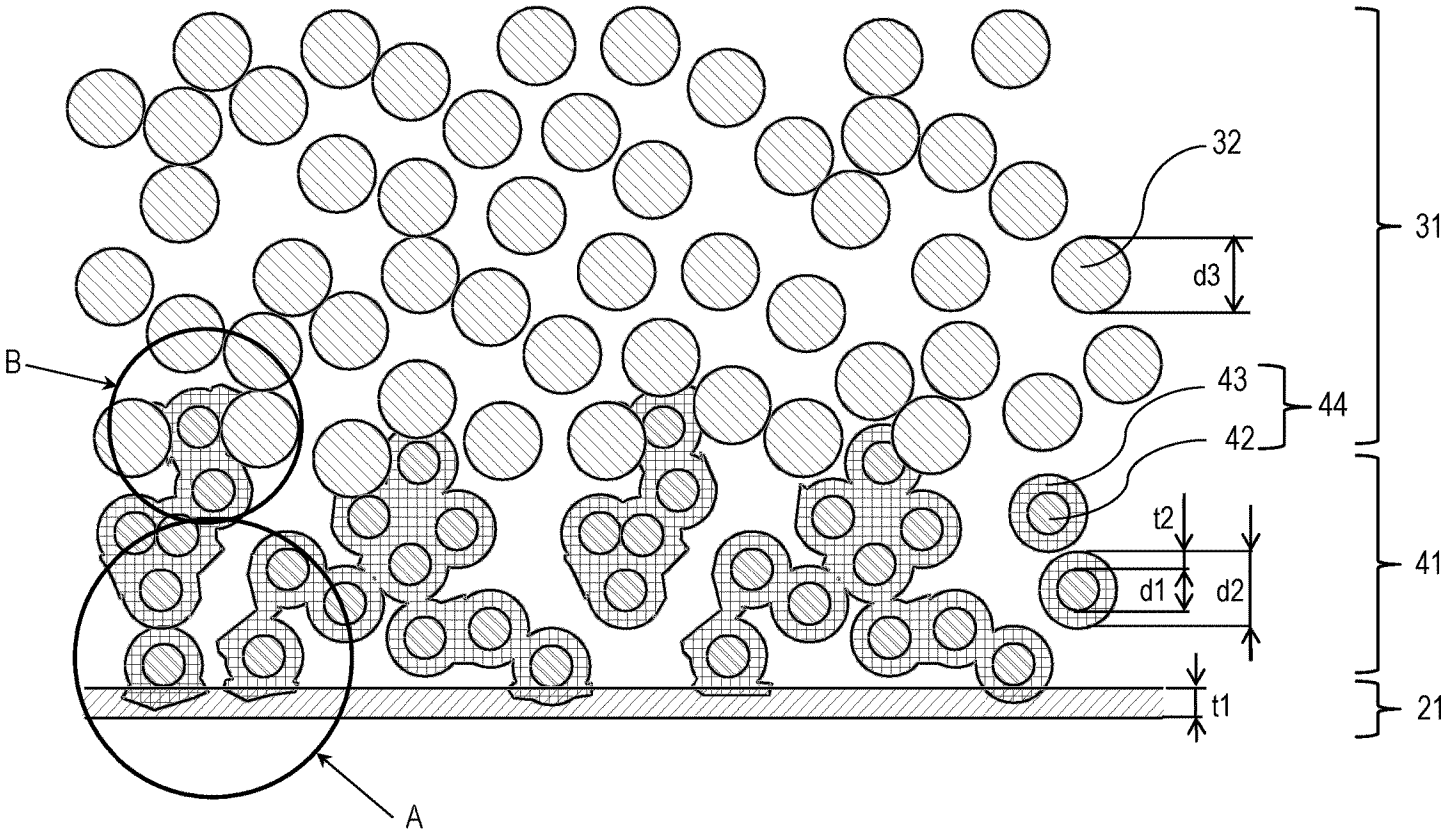
FIG. 6 is a sectional view illustrating one example of a porous body in a first embodiment.

An example of the porous body according to the present embodiment is illustrated in FIG. 6. The porous body as illustrated in FIG. 6 includes a first layer 21, a second layer 41 including a second fiber 44 and a third layer 31 including a third fiber 32. The second fiber 44 has a core-in-sheath structure including a core structure 42 forming a central axis and a sheath structure 43 surrounding the core structure 42. An average fiber diameter d2 of the second fiber 44 is larger than an average fiber diameter d3 of the third fiber 32. An average thickness t2 of the sheath structure 43 is smaller than a thickness t1 of the first layer 21.

The porous body may be formed of the first layer, the second layer and the third layer, and may include other layers in addition to the first layer, the second layer and the third layer. The thickness of the porous body is preferably thin, and can be set to be 50 μm or more to 500 μm or less, from the viewpoint of uniformly obtaining high air permeability. Air permeability can be indicated by the Gurley value defined in JIS P8117, and the Gurley value of the porous body is preferably 10 seconds or shorter. The shape of the porous body is not particularly limited and may be a roller shape or a belt shape.

[First Layer]

The first layer is a layer which is configured to be brought into contact with the first image, and a porous layer which directly contacts the first image so as to absorb at least a portion of the first liquid from the first image. The material for forming the first layer is not particularly limited, but from the viewpoint of suppressing coloring material adhesion and enhancing the cleaning property, it is preferable to include a fluororesin having low surface free energy. That is, the first layer preferably contains a fluororesin, and is more preferably formed of a fluororesin. Specific examples of the fluororesin include polytetrafluoroethylene (PTFE), polychlorotrifluoroethylene (PCTFE), polyvinylidene fluoride (PVDF), polyvinyl fluoride (PVF), perfluoroalkoxy fluororesin (PFA), a tetrafluoroethylene-propylenehexafluoride copolymer (FEP), an ethylene-tetrafluoroethylene copolymer (ETFE) and an ethylene chlorotrifluoroethylene copolymer (ECTFE). These materials may be used alone or if necessary, two or more kinds thereof may be used in combination. In addition, the first layer may have a structure in which a plurality of films having different materials are laminated.

From the viewpoint of setting the softening temperature of the material for forming the first layer to be higher than the softening temperature of the material for forming the sheath structure in the second fiber, the softening temperature of the material for forming the first layer is preferably 170° C. or higher, is more preferably 180° C. or higher, and is still more preferably 200° C. or higher. An upper limit of the range of the softening temperature of the material for forming the first layer is not particularly limited, and for example, it can be set to 350° C. or lower. Note that, the softening temperature in the present invention is a value obtained by measurement through differential scanning calorimetry (DSC). In addition, in a case where the first layer includes a plurality of materials, the softening temperature is indicated in a state where the first layer includes the plurality of materials.

It is desirable that the material for forming the first layer has flexibility to the extent that no trace remains on the first image, and the Young's modulus of the material is preferably 2.0 GPa or less, is more preferably 1.0 GPa or less, and is still more preferably 0.5 GPa or less. A lower limit of the range of the Young's modulus is not particularly limited, and for example, it may be 0.1 GPa or more. Note that, the Young's modulus in the present invention is a value obtained by measurement through the method defined by JIS K7161.

The average pore diameter on the surface which comes into contact with the first image of the first layer is preferably 10.0 μm or smaller, is more preferably 1.0 μm or smaller, and is still more preferably 0.2 μm or smaller, from the viewpoint of suppressing of coloring material adhesion at the time of pressure contact with the first image. Particularly, when the average pore diameter is 0.2 μm or smaller, the filtering property is increased and the coloring material adhesion to the porous body is remarkably suppressed. In the present invention, the average pore diameter is an average value of the values obtained by observing the surface of the porous layer with an electron microscope, and measuring 20 or more diameters as diameters in a case where an area of a hole portion of the surface is an area of a circle. The lower limit of the range of the average pore diameter is not particularly limited, and it may be 0.02 μm or larger, for example.

The thickness of the first layer is preferably 50 μm or smaller, is more preferably 30 μm or smaller, is still more preferably 10 μm or smaller, and is particularly preferably 5 μm or smaller. When the thickness is 50 μm or smaller, an increase in the flow resistance can be suppressed, and the smeared image can be suppressed. The lower limit of the range of the thickness is not particularly limited, and it may be 1 μm or larger, for example. In the present invention, the thickness is a value obtained by measuring the thickness of optional 10 points with a straight type micrometer (product name: OMV-25, manufactured by Mitutoyo Corporation) and calculating the average value thereof.

[Second Layer]

The second layer is a porous layer which adheres the first layer and the third layer. The second layer includes the second fiber and may be formed of the second fiber. Note that, even in a case where a portion of the second fiber is melted, as long as the second fiber remains in a state of being in a fiber shape in the second layer, the second layer is assumed to include the second fiber. The same is true for a second fiber a included in a second layer a and a second fiber b included in a second layer b, which are described below. The second layer may be a nonwoven fabric or a woven fabric. The second fiber has a core-in-sheath structure including a core structure forming the central axis and a sheath structure surrounding the core structure. The material for forming the core structure and the material for forming the sheath structure are not particularly limited as long as the relationship of the softening temperature in the present embodiment is satisfied, and examples thereof include polyolefin (polyethylene (PE), polypropylene (PP) and the like), polyamide such as polyurethane and nylon, polyester (polyethylene terephthalate (PET) and the like) and polysulfone (PSF). These may be used alone, or two or more kinds thereof may be used in combination.

The softening temperature of the material for forming the sheath structure is lower than any of the softening temperature of the material for forming the core structure, the softening temperature of the material for forming the first layer and the softening temperature of the material for forming the third fiber included in the third layer. With this, at the time of adhering the first to the third layers to each other by heating, it is possible to soften only the material for forming the sheath structure by selecting the heating temperature, and the core structure is not melted, and thereby it is possible to maintain the shape of the second fiber. Accordingly, the entire of the second layer is not melted and collapsed, and thereby it is possible to prevent the second layer from being collapsed. The softening temperature of the material for forming the sheath structure is preferably 5° C. or more, and is more preferably 10° C. or more lower than any of the softening temperature of the material for forming the core structure, the softening temperature of the material for forming the first layer and the softening temperature of the material for forming the third fiber included in the third layer.

From the viewpoint of satisfying the relationship of the softening temperature in the present embodiment, the softening temperature of the material for forming the core structure is preferably 140° C. or higher, and is more preferably 150° C. or higher. An upper limit of the range of the softening temperature of the material for forming the core structure is not particularly limited, and for example, it can be set to be 180° C. or lower. From the viewpoint of satisfying the relationship of the softening temperature in the present embodiment, the softening temperature of the material for forming the sheath structure is preferably lower than 140° C., and is more preferably 130° C. or lower. A lower limit of the range of the softening temperature of the material for forming the sheath structure is not particularly limited, and for example, it can be set to be 110° C. or higher.

The Young's modulus of the material for forming the core structure is preferably 0.1 GPa or more to 3.0 GPa or less from the viewpoint of transportability. In addition, the Young's modulus of the material for forming the sheath structure is preferably 0.1 GPa or more to 3.0 GPa or less, from the viewpoint of transportability.

Figure 7A:
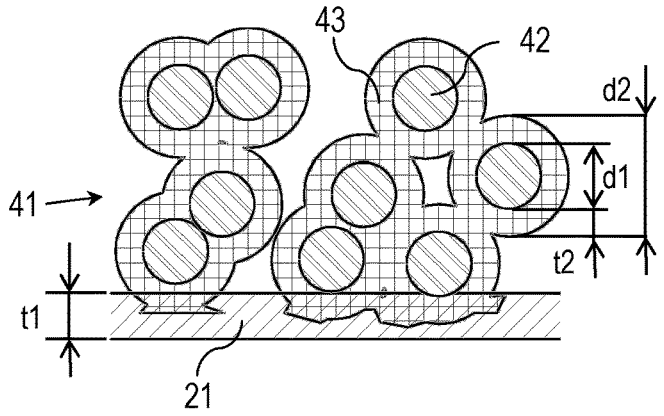
FIG. 7A is a sectional view illustrating an enlarged part of the example of the porous body.
Figure 7B:
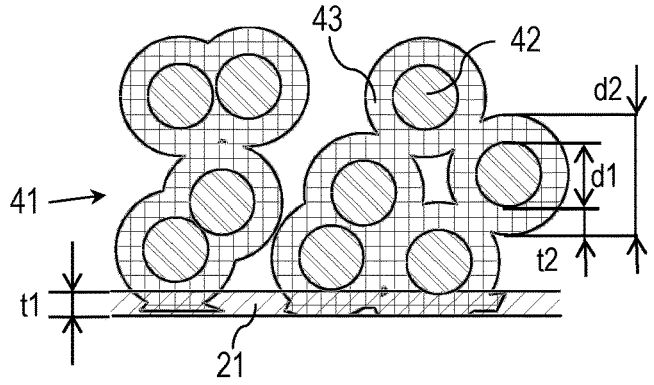
FIG. 7B is a sectional view illustrating an enlarged part of the example of the porous body.

The average thickness of the sheath structure is smaller than the thickness of the first layer. An enlarged view of a portion A of the porous body illustrated in FIG. 6 is illustrated in FIG. 7A. As illustrated in FIG. 7A, in order to prevent the first layer 21 from being collapsed, an average thickness t2 of the sheath structure 43 of the second layer 41 is smaller than the thickness t1 of the first layer 21 ($t2<t1$). On the other hand, in a case where a relationship $t2 \geq t1$ is satisfied, as illustrated in FIG. 7B, the collapse occurs in the first layer 21, and thereby the smeared image occurs. The average thickness of the sheath structure is preferably 1.0 μm or more, and is more preferably 1.5 μm or more smaller than the thickness of the first layer. In addition, as illustrated in FIG. 7A, the first layer 21 and the sheath structure of the second layer is adhered to each other, and thus the adhesive strength between the first layer and the second layer is also enhanced.

From the viewpoint of satisfying the above relationship, the average thickness of the sheath structure is preferably 0.5 μm or larger to 5.0 μm or smaller, and is more preferably 1.0 μm or larger to 4.0 μm or smaller. In addition, the average diameter of the core structure is preferably 1.0 μm or more to 30.0 μm or less, and is more preferably 5.0 μm or more to 20.0 μm or less. Note that, in the present invention, the average thickness of the sheath structure and the average diameter of the core structure are an average value of the measured values at 20 points or more obtained by SEM observation after forming a cross section with ion milling, FIB or the like. In addition, although the sheath structure is partially melted, the average thickness of the sheath structure is measured and calculated for the unmelted portions.

Figure 7C:
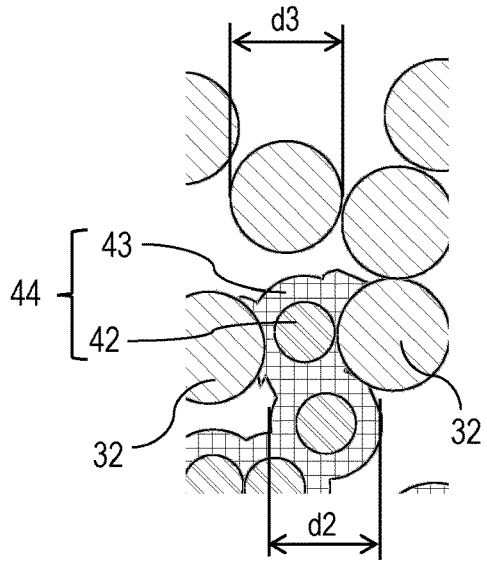
FIG. 7C is a sectional view illustrating an enlarged part of the example of the porous body.
Figure 7D:
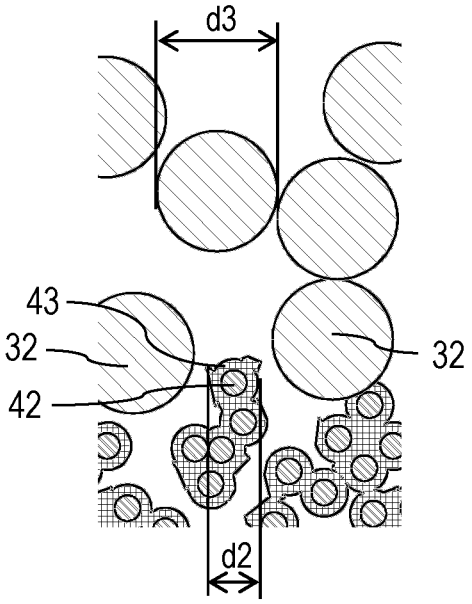
FIG. 7D is a sectional view illustrating an enlarged part of the example of the porous body.
Figure 7E:
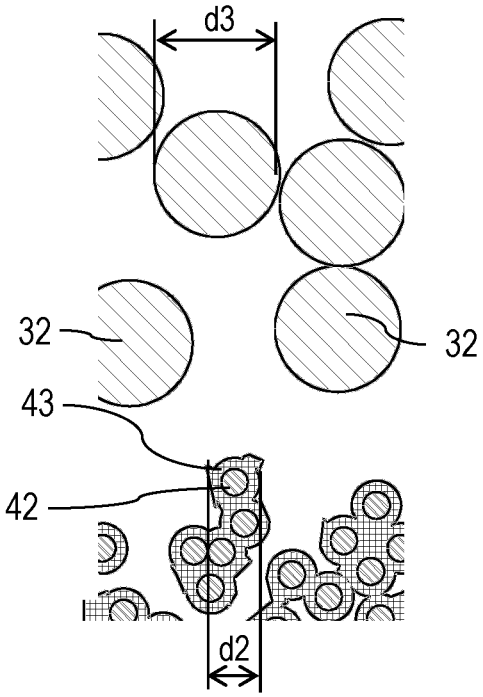
FIG. 7E is a sectional view illustrating an enlarged part of the example of the porous body.

The average fiber diameter of the second fiber is larger than the average fiber diameter of the third fiber. An enlarged view of a portion B of the porous body illustrated in FIG. 6 is illustrated in FIG. 7C. As illustrated in FIG. 7C, the average fiber diameter d2 of the second layer is larger than the average fiber diameter d3 of the third layer ($d2>d3$). With this, when the second fiber 44 of the second layer enters between the third fibers 32 of the third layer, the third fiber 32 and the second fiber 44 are adhered to each other by melting the sheath structure 43, and the adhesive strength is enhanced by the anchor effect. On the other hand, in a case where a relationship $d2 \leq d3$ is satisfied, as illustrated in FIG. 7D, the second fiber 44 of the second layer cannot be adhered to the third fiber 32 of the third layer by the anchor effect, and as illustrated in FIG. 7E, the second layer and the third layer are easily separated from each other. The average fiber diameter of the second fiber is preferably 1 μm or more, and is more preferably 2 μm or more larger than the average fiber diameter of the third fiber.

From the viewpoint of satisfying the above relationship, the average fiber diameter of the second fiber is preferably 10 μm or larger to 50 μm or smaller, and is more preferably 15 μm or larger to 30 μm or smaller. Note that, in the present invention, the average fiber diameter is an average value of the measured values at 20 points or more obtained by SEM observation from the surface or SEM observation after forming a cross section with ion milling, FIB or the like. In addition, although the sheath structure is partially melted, the average fiber diameter is measured and calculated for the unmelted portions.

The thickness of the second layer is preferably 10 to 500 μm from the viewpoint of transportability.

[Third Layer]

The third layer is a porous layer that enhances the rigidity of the liquid absorbing member. The third layer includes the third fiber and may be formed of the third fiber. The third layer may be a nonwoven fabric or a woven fabric. The material for forming the third fiber is not particularly limited as long as the relationship of the softening temperature in the present invention is satisfied, and examples thereof include polyphenylene sulfide (PPS), polyimide, and polyethylene terephthalate (PET). These may be used alone, or two or more kinds thereof may be used in combination. However, from the viewpoint that the Young's modulus is high and the conveying strength can be enhanced as described below, it is preferable the third fiber includes polyphenylene sulfide (PPS) or polyimide.

From the viewpoint of satisfying the relationship of the softening temperature in the present invention, the softening temperature of the material for forming the third fiber is preferably 150° C. or higher, is more preferably 170° C. or higher, and is still more preferably 200° C. or higher. An upper limit of the range of the softening temperature of the material for forming the third fiber is not particularly limited, and for example, it can be set to be 350° C. or lower.

From the viewpoint of enhancing the conveying strength and securing the rigidity, Young's modulus of a material for forming the third fiber is preferably higher than the Young's modulus of the material for forming the first layer. The Young's modulus of a material for forming the third fiber is preferably 1.0 GPa or more, and is more preferably 2.0 GPa or more higher than the Young's modulus of the material for forming the first layer. The Young's modulus of a material for forming the third fiber is preferably 2.0 GPa or more, is more preferably 2.5 GPa or more, and is still more preferably 3.0 GPa or more. An upper limit of the range of the Young's modulus is not particularly limited, and for example, it may be 5.0 GPa or less. The third layer formed of the material having the Young's modulus roughly determines the rigidity of the porous sheet at last. A tension of about 2.5 mN/mm or more to 10.0 mN/mm or less is applied to the porous sheet at the time of conveyance for stable conveyance. At that time, when the elongation of the porous sheet is large, it is impossible to secure conveyance stability against tension variation or the like. In order to secure the conveyance stability, in the range of 2.5 mN/mm or more to 10.0 mN/mm or less, it is preferable to suppress the elongation to 2% or less in the range of elastic deformability. The tension and the elongation in the range of elastic deformability is a value measured by "Autograph AG-X" (trade name) manufactured by Shimadzu Corporation.

From the viewpoint of enhancing the conveying strength and securing the rigidity, the thickness of the third layer is preferably 50 μm or larger to 500 μm or smaller, is more preferably 100 μm or larger to 400 μm or smaller, and is still more preferably 150 μm or larger to 300 μm or smaller. From the viewpoint that the average fiber diameter of the third fiber is set to be smaller than the average fiber diameter of the second fiber, the average fiber diameter of the third fiber is preferably 2 μm or more to 15 μm or less, and is more preferably 5 μm or more to 10 μm or less.

Second Embodiment

Other porous body of the present embodiment is porous sheets in which a first layer which is brought into contact with a first image, a second layer a including a second fiber a, a second layer b including a second fiber b and a third layer including a third fiber are laminated in this order, and satisfies the following requirements (1) to (5). (1) An average fiber diameter of the second fiber b is larger than an average fiber diameter of the third fiber. (2) The second fiber a and the second fiber b have a core-in-sheath structure including a core structure forming the central axis and a sheath structure surrounding the core structure. (3) A softening temperature of the material for forming the sheath structure of the second fiber a is lower than any of a softening temperature of the material for forming the core structure of the second fiber a and a softening temperature of the material for forming the first layer. (4) A softening temperature of the material for forming the sheath structure of the second fiber b is lower than any of a softening temperature of the material for forming the core structure of the second fiber b and a softening temperature of the material for forming the third fiber. (5) An average thickness of the sheath structure of the second fiber a is smaller than a thickness of the first layer.

Figure 8:
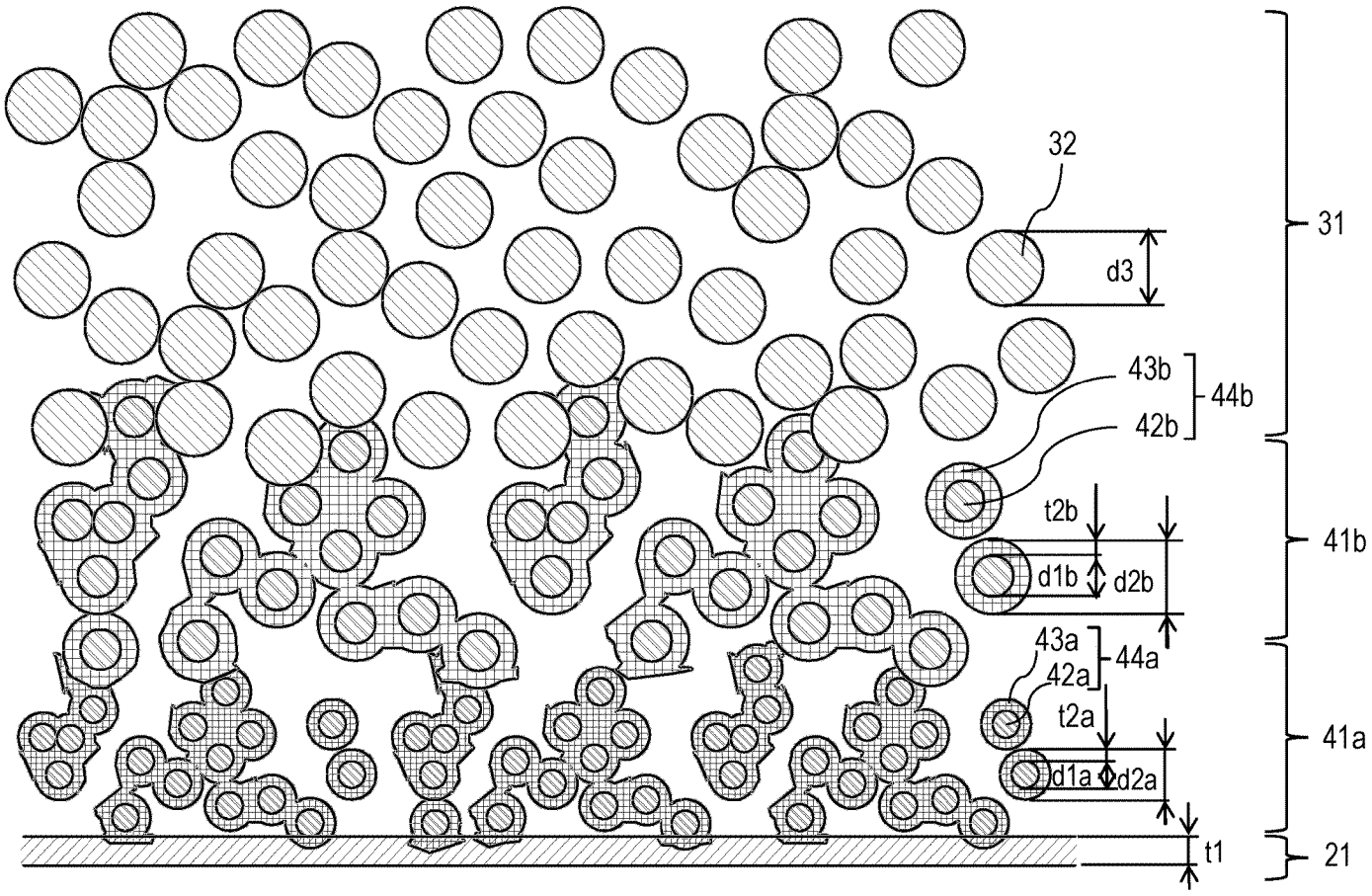
FIG. 8 is a sectional view illustrating one example of a porous body in a second embodiment.

An example of the porous body according to the present embodiment is illustrated in FIG. 8. The porous body as illustrated in FIG. 8 includes a first layer 21, a second layer a41*a* including a second fiber a44*a*, a second layer b41*b* including a second fiber b44*b* and a third layer 31 including a third fiber 32. The second fiber a44*a* has a core-in-sheath structure including a core structure 42*a* forming a central axis and a sheath structure 43*a* surrounding the core structure 42*a*. In addition, the second fiber b44*b* has a core-in-sheath structure including a core structure 42*b* forming a central axis and a sheath structure 43*b* surrounding the core structure 42*b*. An average fiber diameter d2*b* of the second fiber b44*b* is larger than an average fiber diameter d3 of the third fiber 32. An average thickness t2*a* of the sheath structure 43*a* of the second fiber a44*a* is smaller than the thickness t1 of the first layer 21.

In the first embodiment as illustrated in FIG. 6, when the average fiber diameter d2 of the second fiber 44 is set to be excessively large in order to make the average fiber diameter d2 of the second fiber 44 larger than the average fiber diameter d3 of the third fiber 32, irregularities on the surface of the second layer 41 may spread to the first layer 21 in some cases. In this case, the image may be disturbed in absorption of the first liquid from the first image. On the other hand, in the present embodiment, the second layer in the first embodiment is formed of the second layer a41*a* including the second fiber a44*a* and the second layer b41*b* including the second fiber b44*b*. The second layer a41*a* is disposed on the first layer 21 side, and the second layer b41*b* is disposed on the third layer 31 side. Here, a dimension of the core-in-sheath structure of the second fiber a44*a* and a dimension of the core-in-sheath structure of the second fiber b44*b* can be different from each other, and thus it is possible to easily make the average fiber diameter of the second fiber larger than the average fiber diameter of the third fiber while suppressing the irregularities of the surface on the first layer side of the second layer. That is, when the average fiber diameter d2*b* of the second fiber b44*b* is larger than the average fiber diameter d3 of the third fiber 32 (d2*b*>d3), and the average thickness t2*a* of the sheath structure 43*a* of the second fiber a44*a* is smaller than the thickness t1 of the first layer 21 (t1>t2*a*), it is possible to easily achieve the prevention of the collapse of the first layer and enhancement of the adhesive strength between the second layer and the third layer while suppressing the irregularities of the surface on the first layer side of the second layer.

[First Layer and Third Layer]

The first layer and the third layer in the present embodiment can have the same configuration as that of the first layer and the third layer in the first embodiment.

[Second Layer a]

The second layer a is a porous layer which is disposed on the first layer side and adheres to the first layer. The second layer a includes a second fiber a and may be formed of the second fiber a. The second layer a may be a nonwoven fabric or a woven fabric. The second fiber a has a core-in-sheath structure including a core structure forming the central axis and a sheath structure surrounding the core structure. A material for forming the core structure and a material for forming the sheath structure of the second fiber a are not particularly limited as long as they satisfy the relationship of the softening temperature in the present embodiment, and the same material as that of the second fiber in the first embodiment can be used.

A softening temperature of the material for forming the sheath structure of the second fiber a is lower than any of a softening temperature of the material for forming the core structure of the second fiber a and a softening temperature of the material for forming the first layer. With this, at the time of adhering the first layer and the second layer a to each other by heating, it is possible to soften only the material for forming the sheath structure of the second fiber a by selecting the heating temperature, and the core structure of the second fiber a is not melted. Accordingly, it is possible to maintain the shape of the second fiber a, and to prevent the second layer a from being collapsed. The softening temperature of the material for forming the sheath structure of the second fiber a is preferably 5° C. or more, and is more preferably 10° C. or more lower than any of the softening temperature of the material for forming the core structure of the second fiber a and the softening temperature of the material for forming the first layer.

From the viewpoint of satisfying the relationship of the softening temperature in the present embodiment, the softening temperature of the material for forming the core structure of the second fiber a is preferably 140° C. or higher, and is more preferably 150° C. or higher. An upper limit of the range of the softening temperature of the material for forming the core structure of the second fiber a is not particularly limited, and for example, it can be set to be 180° C. or lower. In addition, from the viewpoint of satisfying the relationship of the softening temperature in the present embodiment, the softening temperature of the material for forming the sheath structure of the second fiber a is preferably lower than 140° C., and is more preferably 130° C. or lower. A lower limit of the range of the softening temperature of the material for forming the sheath structure of the second fiber a is not particularly limited, and for example, it can be set to be 110° C. or higher.

The Young's modulus of the material for forming the core structure of the second fiber a is preferably 0.1 GPa or more to 3.0 GPa or less from the viewpoint of transportability. Further, the Young's modulus of the material for forming the sheath structure of the second fiber a is preferably 0.1 GPa or more to 3.0 GPa or less from the viewpoint of transportability.

The average thickness of the sheath structure of the second fiber a is smaller than the thickness of the first layer from the viewpoint of suppressing the smeared image due to the collapse of the first layer. The average thickness of the sheath structure of the second fiber a is preferably 1.0 μm or more, and is more preferably 2.0 μm or more smaller than the thickness of the first layer. From the viewpoint of satisfying the above relationship, the average thickness of the sheath structure of the second fiber a is preferably 0.5 μm or larger to 5.0 μm or smaller, and is more preferably 1.0 μm or larger to 3.0 μm or smaller. In addition, the average diameter of the core structure of the second fiber a is preferably 1.0 μm or more to 10.0 μm or less, and is more preferably 2.0 μm or more to 8.0 μm or less.

From the viewpoint of suppressing the irregularities of the surface of the second layer a, the average fiber diameter of the second fiber a is preferably 1 μm or more to 10 μm or less, and is more preferably 2 μm or more to 8 μm or less. The thickness of the second layer a is preferably 10 μm or more to 500 μm or less from the viewpoint of transportability.

[Second Layer b]

The second layer b is a porous layer which is disposed on the third layer side and adheres to the third layer. The second layer b includes a second fiber b and may be formed of the second fiber b. The second layer b may be a nonwoven fabric or a woven fabric. The second fiber b has a core-in-sheath structure including a core structure forming the central axis and a sheath structure surrounding the core structure. A material for forming the core structure and a material for forming the sheath structure of the second fiber b are not particularly limited as long as they satisfy the relationship of the softening temperature in the present embodiment, and the same material as that of the second fiber in the first embodiment can be used.

A softening temperature of the material for forming the sheath structure of the second fiber b is lower than any of a softening temperature of the material for forming the core structure of the second fiber b and a softening temperature of the material for forming the third fiber. With this, at the time of adhering the second layer b and the third layer to each other by heating, it is possible to soften only the material for forming the sheath structure of the second fiber b by selecting the heating temperature, and the core structure of the second fiber b is not melted. Accordingly, it is possible to maintain the shape of the second fiber b and to prevent the second layer b from being collapsed. The softening temperature of the material for forming the sheath structure of the second fiber b is preferably 5° C. or more, and is more preferably 10° C. or more lower than any of the softening temperature of the material for forming the core structure of the second fiber b and the softening temperature of the material for forming the third layer.

From the viewpoint of satisfying the relationship of the softening temperature in the present embodiment, the softening temperature of the material for forming the core structure of the second fiber b is preferably 140° C. or higher, and is more preferably 150° C. or higher. An upper limit of the range of the softening temperature of the material for forming the core structure of the second fiber b is not particularly limited, and for example, it can be set to be 180° C. or lower. In addition, from the viewpoint of satisfying the relationship of the softening temperature in the present embodiment, the softening temperature of the material for forming the sheath structure of the second fiber b is preferably lower than 140° C., and is more preferably 130° C. or lower. A lower limit of the range of the softening temperature of the material for forming the sheath structure of the second fiber b is not particularly limited, and for example, it can be set to be 110° C. or higher.

The Young's modulus of the material for forming the core structure of the second fiber b is preferably 0.1 GPa or more to 3.0 GPa or less from the viewpoint of transportability. Further, the Young's modulus of the material for forming the sheath structure of the second fiber b is preferably 0.1 GPa or more to 3.0 GPa or less from the viewpoint of transportability.

The average thickness of the sheath structure of the second fiber a is preferably 0.5 μm or larger to 5.0 μm or smaller, and is more preferably 1.0 μm or larger to 4.0 μm or smaller. In addition, the average diameter of the core structure of the second fiber a is preferably 1.0 μm or larger to 30.0 μm or smaller, and is more preferably 5.0 μm or larger to 20.0 μm or smaller.

From the viewpoint of enhancing the adhesive strength between the second layer b and the third layer, the average fiber diameter of the second fiber b is larger than the average fiber diameter of the third fiber. The average fiber diameter of the second fiber b is preferably 1 μm or more, and is more preferably 2 μm or more larger than the average fiber diameter of the third fiber. From the viewpoint of satisfying the above relationship, the average fiber diameter of the second fiber b is preferably 10 μm or larger to 50 μm or smaller, and is more preferably 15 μm or larger to 30 μm or smaller. The thickness of the second layer b is preferably 10 μm or larger to 500 μm or smaller from the viewpoint of transportability.

(Method of Producing Porous Body)

In the first embodiment, it is possible to produce a porous body in which a first layer which is brought into contact with the first image, a second layer including a second fiber and a third layer including a third fiber are laminated in this order by heating. A temperature of the heating is equal to or higher than the softening temperature of the material for forming the sheath structure, and is equal to or lower than the softening temperature of the material for forming the core structure, the softening temperature of the material for forming the first layer and the softening temperature of the material for forming the third fiber. With this, it is possible to soften only the material for forming the sheath structure, and the core structure is not melted, and thereby it is possible to maintain the shape of the second fiber. Accordingly, the entire of the second layer is not melted and collapsed, and thereby it is possible to prevent the second layer from being collapsed. In addition, the heating temperature is preferably equal to or higher than the softening temperature of the material for forming the sheath structure and lower than the softening temperature of the material for forming the core structure, the softening temperature of the material for forming the first layer and the softening temperature of the material for forming the third fiber. Further, the heating temperature depends on the material to be used, but is preferably 100° C. or higher to 150° C. or lower, for example.

In the second embodiment, it is possible to produce a porous body in which a first layer which is brought into contact with the first image, a second layer a including a second fiber a, a second layer b including a second fiber b and a third layer including a third fiber are laminated in this order by heating. A temperature of the heating is equal to or higher than the softening temperature of the material for forming the sheath structure of the second fiber a and the second fiber b, and is equal to or lower than the softening temperature of the material for forming the core structure of the second fiber a and the second fiber b, the softening temperature of the material for forming the first layer and the softening temperature of the material for forming the third fiber. With this, it is possible to soften only the material for forming the sheath structure of the second fiber a and the second fiber b, and the core structure of the second fiber a and the second fiber b is not melted, and thereby it is possible to maintain the shape of the second fiber a and the second fiber b. Accordingly, the entire of the second layer a and the second layer b is not melted and collapsed, and thereby it is possible to prevent the second layer a and the second layer b from being collapsed. Further, the heating temperature is equal to or higher than the softening temperature of the material for forming the sheath structure of the second fiber a and the second fiber b, and is lower than the softening temperature of the material for forming the core structure of the second fiber a and the second fiber b, the softening temperature of the material for forming the first layer and the softening temperature of the material for forming the third fiber. Further, the heating temperature depends on the material to be used, but can be 100° C. or higher to 150° C. or lower, for example.

Pressurization may be performed at the same time when heating is performed. For example, a method of laminating while pressurizing by sandwiching the laminate with the heated roller is preferable. At this time, it is preferable that the material for forming the sheath structure of the second layer (the second layer a and the second layer b) penetrates into the pores of the first layer and the third layer to such an extent that it does not collapse. Further, the heating may be performed after laminating all of the layers, or laminating and heating may be performed sequentially in such a manner that two layers are laminated and heated, and then other layers are further laminated and heated.

Figure 9:
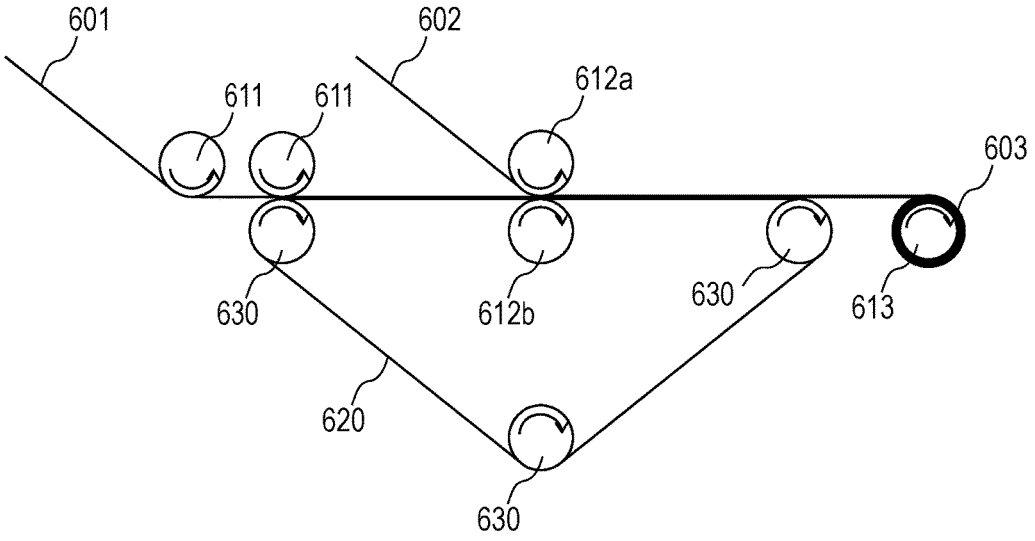
FIG. 9 is a schematic view illustrating one example of a laminator usable for producing a porous body according to the present invention.

An example of a laminator which can be used in the method of producing a porous body is illustrated in FIG. 9. In the laminator illustrated in FIG. 9, a porous body can be produced by sequentially laminating and heating each layer. The laminator is provided with a conveyance belt 620 for conveying and laminating each sheet to be laminated. The conveyance belt 620 is driven by a belt conveyance roller 630. A first sheet 601 is conveyed by a first sheet conveyance roller 611. The first sheet 601 and the second sheet 602 are heated, pressurized and welded by heated nip rollers 612*a* and 612*b*. A welded laminate sheet 603 is wound by a winding roller 613. It is preferable that the temperatures of the nip rollers 612*a* and 612*b* are the temperatures of the heating.

Specific embodiments of an ink jet recording apparatus of the present invention will be described.

Examples of the ink jet recording apparatus of the present invention include an ink jet recording apparatus which forms a first image on a transfer body as an ink receiving medium, and transfers a second image after absorption of a first liquid by a liquid absorbing member to a recording medium and an ink jet recording apparatus which forms a first image on a recording medium as an ink receiving medium. In the present invention, the former ink jet recording apparatus will hereinafter be referred to as a transfer type ink jet recording apparatus for the sake of convenience, and the latter ink jet recording apparatus will hereinafter be referred to as a direct drawing type ink jet recording apparatus for the sake of convenience.

Each ink jet recording apparatus will be described below.

(Transfer-Type Ink Jet Recording Apparatus)

FIG. 1 is a schematic diagram illustrating one example of a schematic configuration of the transfer type ink jet recording apparatus of the present embodiment.

The transfer type ink jet recording apparatus 100 includes a transfer body 101 for temporarily holding a first image and a second image obtained by absorbing at least a portion of a first liquid from the first image. The transfer type ink jet recording apparatus 100 also includes a transfer unit including a pressing member 106 for transferring which transfers the second image onto a recording medium 108 on which an image is to be formed.

The transfer type ink jet recording apparatus 100 of the present invention includes the transfer body 101 supported by a support member 102, a reaction liquid applying device 103 for applying a reaction liquid onto the transfer body 101, an ink applying device 104 for applying ink onto the transfer body 101 on which the reaction liquid is applied so as to form an ink image (the first image) on the transfer body, a liquid absorbing device 105 for absorbing a liquid component from the first image on the transfer body, and the pressing member 106 for transferring the second image on the transfer body from which the liquid component has been removed onto the recording medium 108 such as paper by pressing the recording medium. In addition, the transfer type ink jet recording apparatus 100 may include a cleaning member for transfer body 109 for cleaning the surface of the transfer body 101 after the second image is transferred onto the recording medium 108.

The support member 102 rotates about a rotation axis 102*a* in the direction of an arrow A in FIG. 1. With the rotation of the support member 102, the outer circumferential surface of the transfer body 101 is moved in the direction of an arrow A. The application of the reaction liquid by the reaction liquid applying device 103 and the application of the ink by the ink applying device 104 are sequentially performed on the transfer body 101 to be moved, and thereby the first image is formed on the transfer body 101. The first image formed on the transfer body 101 is moved to a position where the first image comes into contact with the liquid absorbing member 105*a* of the liquid absorbing device 105 by the rotational movement of the transfer body 101.

The liquid absorbing member 105*a* of the liquid absorbing device 105 moves in synchronization with the rotation of the transfer body 101. The first image formed on the transfer body 101 passes through a state of being in contact with the moving liquid absorbing member 105*a*. During this time, the liquid absorbing member 105*a* removes the liquid component from the first image.

Note that, the liquid component contained in the first image is removed by passing through the state of being in contact with the liquid absorbing member 105*a*. In this contact state, it is preferable that the liquid absorbing member 105*a* is pressed against the first image with a predetermined pressing force in order to effectively function the liquid absorbing member 105*a*.

The removal of the liquid component can be expressed from a different point of view as concentrating the ink constituting the first image formed on the transfer body. Concentrating the ink means that the proportion of the solid content contained in the ink, such as coloring material and resin, with respect to the liquid component contained in the ink increases owing to reduction in the liquid component.

Then, the second image after the liquid component has been removed is moved to a transfer unit which is in contact with the recording medium 108 conveyed by a conveyance device for recording medium 107 by the rotational movement of the transfer body 101. While the second image from which the liquid component is removed and the recording medium 108 are in contact with each other, the pressing member 106 presses the recording medium 108, and thereby an ink image is formed on the recording medium 108. The post-transfer ink image transferred onto the recording medium 108 is a reverse image of the second image. In the following description, the post-transfer ink image may be referred to as a third image separately from the first image (the ink image before liquid removal) and the second image (the ink image after liquid removal) described above.

Note that, since the first image is formed by applying ink after the reaction liquid is applied onto the transfer body, the reaction liquid remains in a non-image region (a non-ink image forming area) without reacting with the ink. In this apparatus, the liquid absorbing member 105*a* not only removes the liquid component from the first image, but also comes into contact (pressure contact) with the unreacted reaction liquid to also remove the liquid component of the reaction liquid from the surface of the transfer body 101.

Therefore, in the above description, it is expressed and described that the liquid component is removed from the first image, but this is not limited to the meaning that the liquid component is removed from only the first image, and means that a liquid component is removed from at least the first image on the transfer body. For example, it is also possible to remove the liquid component in the reaction liquid applied to the outer region of the first image together with the first image.

Note that, the liquid component is not particularly limited as long as it does not have a certain shape, has fluidity, and has a substantially constant volume. For example, water, an organic solvent or the like contained in the ink and the reaction liquid is exemplified as a liquid component.

Also, even in a case where the clear ink is contained in the first image, it is possible to concentrate the ink by the liquid absorption treatment. For example, when the clear ink is applied onto the color ink containing the coloring material applied onto the transfer body 101, the clear ink is present on the entire surface of the first image, or the clear ink is partially present at one or more places on the surface of the first image, and the color ink is present in other places. In the first image, in the places where the clear ink is present on the color ink, the porous body absorbs the liquid component of the clear ink on the surface of the first image and the liquid component of the clear ink moves. Accordingly, the liquid component in the color ink moves to the porous body side, and thereby the liquid component in the color ink is absorbed. On the other hand, in the places where a region of the clear ink and a region of the color ink are present on the surface of the first image, the respective liquid components of the color ink and the clear ink move to the porous body side, and thereby the liquid components are absorbed. Note that, the clear ink may contain a large amount of components for improving transferability of the image from the transfer body 101 to the recording medium 108. For example, the content of the component that increases the adhesiveness to the recording medium by heating may be higher than that of the color ink.

Each configuration of the transfer type ink jet recording apparatus of this embodiment will be described below.

<Transfer Body>

A transfer body 101 includes a surface layer including an image forming surface. As a member of the surface layer, various materials such as a resin and ceramics can be appropriately used, but from the viewpoint of durability and the like, a material having high compressive elastic modulus is preferable. Specifically, examples thereof include a condensate obtained by condensing an acrylic resin, an acrylic silicone resin, a fluorine-containing resin and a hydrolyzable organosilicon compound. In order to improve the wettability and the transferability of the reaction liquid, the surface treatment may be performed before use. Examples of the surface treatment include a frame treatment, a corona treatment, a plasma treatment, a polishing treatment, a roughening treatment, an active energy ray irradiation treatment, an ozone treatment, a surfactant treatment and a silane coupling treatment. These may be combined in plural. An optional surface shape can also be provided on the surface layer.

Further, it is preferable that the transfer body includes a compressible layer having a function of absorbing pressure variation. When the compressible layer is provided, the compressible layer absorbs the deformation and disperses the variation against local pressure variation, and thus it is possible to maintain excellent transferability even during high-speed printing. Examples of members of the compressible layer include acrylonitrile-butadiene rubber, acrylic rubber, chloroprene rubber, urethane rubber and silicone rubber. It is preferable that at the time of molding the rubber material, a predetermined amount of a vulcanizing agent, a vulcanization accelerator and the like are blended and a filler such as a foaming agent, a hollow fine particle or salt is further blended, as necessary, to make the rubber material porous. As a result, a bubble portion is compressed with volume change for various pressure fluctuations, so that deformation in a direction other than the compression direction is small and a more stable transferability and the durability can be obtained. As the porous rubber material, there are one having continuous pore structure in which the pores are continuous to each other and one having independent pore structure in which the pores are independently separated from each other. In the present invention, any structure may be used, and these structures may be used in combination.

Further, the transfer body preferably includes an elastic layer between the surface layer and the compressible layer. As a material of the elastic layer, various materials such as resin, ceramics and the like can be appropriately used. Various elastomer materials and rubber materials are preferably used from the viewpoint of processing characteristics and the like. Specific examples thereof include fluorosilicone rubber, phenyl silicone rubber, fluororubber, chloroprene rubber, urethane rubber, nitrile rubber, ethylene propylene rubber, natural rubber, styrene rubber, isoprene rubber, butadiene rubber, a copolymer of ethylene/propylene/butadiene and nitrile butadiene rubber. In particular, silicone rubber, fluorosilicone rubber and phenyl silicone rubber are preferable in terms of dimensional stability and the durability because of small compression set. In addition, the change in the elastic modulus due to temperature is small, which is also preferable from the viewpoint of transferability.

Various adhesives or double-sided tapes may be used between the layers constituting the transfer body (the surface layer, the elastic layer, and the compressible layer) in order to fix and hold the layers. A reinforcing layer having a high compressive elastic modulus may be provided for suppressing lateral elongation when being mounted on the device and for maintaining elasticity. Further, the woven fabric may be used as a reinforcing layer. The transfer body can be produced by optionally combining each layer by the above-described material.

The size of the transfer body can be freely selected according to the size of the target print image. The shape of the transfer body is not particularly limited, and specifically, examples thereof include a sheet shape, a roller shape, a belt shape, and an endless web shape.

<Support Member>

The transfer body 101 is supported on the support member 102. As a method of supporting the transfer body, various adhesives or double-sided tapes may be used. Alternatively, by attaching a mounting member made of a material such as metal, ceramic and a resin to the transfer body, the transfer body 101 may be supported on the support member 102 using the mounting member.

The support member 102 is required to have a certain degree of structural strength from the viewpoint of conveying accuracy and durability. For the material of the support member, metal, ceramic, resin or the like is preferably used. Among them, in particular, in order to improve responsiveness of control by reducing inertia during operation in addition to rigidity and dimensional accuracy that can withstand pressurization at the time of transfer, aluminum, iron, stainless steel, acetal resin, epoxy resin, polyimide, polyethylene, polyethylene terephthalate, nylon, polyurethane, silica ceramics and alumina ceramics are preferably used. Further, it is also preferable to use these materials in combination.

<Reaction Liquid Applying Device>

The ink jet recording apparatus of the present embodiment includes the reaction liquid applying device 103 for applying the reaction liquid to the transfer body 101. The reaction liquid applying device 103 illustrated in FIG. 1 indicates a gravure offset roller which is provided with a reaction liquid storing unit 103*a* for storing the reaction liquid and a reaction liquid applying units 103*b* and 103*c* for applying the reaction liquid in the reaction liquid storing unit 103*a* onto the transfer body 101.

<Ink Applying Device>

The ink jet recording apparatus of the present embodiment includes an ink applying device 104 that applies ink to the transfer body 101 to which the reaction liquid is applied. The first image is formed by mixing the reaction liquid and the ink, and in the subsequent liquid absorbing device 105, the liquid component is absorbed from the first image.

<Liquid Absorbing Device>

In this embodiment, the liquid absorbing device 105 includes the liquid absorbing member 105*a* and a pressing member 105*b* for liquid absorption which presses the liquid absorbing member 105*a* against the first image on the transfer body 101. Note that, the shapes of the liquid absorbing member 105*a* and pressing member 105*b* are not particularly limited. For example, as illustrated in FIG. 1, a configuration in which the pressing member 105*b* has a columnar shape, the liquid absorbing member 105*a* has a belt shape, and the liquid absorbing member 105*a* having the belt shape is pressed against the transfer body 101 by the pressing member 105*b* having the columnar shape may be employed. In addition, a configuration in which the pressing member 105*b* has a columnar shape, the liquid absorbing member 105*a* has a cylindrical shape formed on the peripheral surface of the pressing member 105*b* having the columnar shape, and the liquid absorbing member 105*a* having the cylindrical shape is pressed against the transfer body by the pressing member 105*b* having the columnar shape may be employed.

In the present invention, it is preferable that the liquid absorbing member 105*a* has the belt shape in consideration of the space and the like in the ink jet recording apparatus.

In addition, the liquid absorbing device 105 which includes the liquid absorbing member 105*a* having such a belt shape may include an extending member for extending the liquid absorbing member 105*a*. In FIG. 1, reference numerals 105*c*, 105*d*, and 105*e* represent an extending roller as the extending member. In FIG. 1, the pressing member 105*b* is also a roller member that rotates similarly to the extending roller, but the present invention is not limited thereto.

In the liquid absorbing device 105, when the liquid absorbing member 105*a* including the porous body is pressed to the first image by the pressing member 105*b*, the second image is obtained by absorbing the liquid component contained in the first image to the liquid absorbing member 105*a*, and decreasing the liquid component from the first image. As a method of decreasing the liquid component from the first image, in addition to the present method of pressing the liquid absorbing member, other various conventionally used methods, for example, a method of heating, a method of blowing low humidity air and a method of reducing pressure may be used in combination. Alternatively, these methods may be applied to the second image with decreased liquid component to further decrease the liquid component.

Hereinafter, various conditions and configurations in the liquid absorbing device 105 will be described in detail.

(Pretreatment)

In the present embodiment, a pretreatment is preferably performed by a pretreatment device (not shown in FIGS. 1 and 2) for applying a wetting liquid (also referred to as a treatment liquid) to the liquid absorbing member before bringing the liquid absorbing member 105*a* having the porous body into contact with the first image. The wetting liquid used in the present invention preferably contains water and a water-soluble organic solvent. Water is preferably deionized water by ion exchange or the like. Further, the kinds of the water-soluble organic solvents are not particularly limited, and any of known organic solvents such as ethanol and isopropyl alcohol can be used. In the pretreatment of the liquid absorbing member used in the present invention, the method of applying the wetting liquid to the porous body is not particularly limited, and immersion and liquid droplet dripping are preferable. The component for adjusting the surface tension of the wetting liquid is not particularly limited, but it is preferable to use a surfactant. As the surfactant, it is preferable to use at least one of a silicone-based surfactant and a fluorine-based surfactant, and is more preferable to use the fluorine-based surfactant. In addition, the content of the surfactant in the wetting liquid is preferably 0.2% by mass or larger, is more preferably 0.4% by mass or larger, and is particularly preferably 0.5% by mass or larger, with respect to the total mass of the wetting liquid. The upper limit of the content of the surfactant in the wetting liquid is not particularly limited, and is preferably 10% by mass with respect to the total mass of the wetting liquid from the viewpoint of solubility of the surfactant in the wetting liquid.

(Pressurizing Condition)

When the pressure of the liquid absorbing member pressing against the first image on the transfer body is 2.9 $N/cm^2$ (0.3 $kgf/cm^2$) or more, the liquid component in the first image can be solid-liquid separated in a shorter time period, and the liquid component can be removed from the first image, which is preferable. Further, when the pressure is 98 $N/cm^2$ (10 $kgf/cm^2$) or less, the structural load on the apparatus can be suppressed, which is preferable. Note that, in the present specification, the pressure of the liquid absorbing member indicates a nip pressure between the ink receiving medium and the liquid absorbing member, and the value is calculated by performing surface pressure measurement by using a surface pressure distribution measuring device (I-SCAN (product name), manufactured by NITTA Corporation), and dividing the load in the pressurized region by the area.

(Application Time)

It is preferable that the application time of bringing the liquid absorbing member 105*a* into contact with the first image is within 50 ms (milliseconds) in order to further suppress the adhesion of the coloring material in the first image to the liquid absorbing member. Incidentally, the application time in the present specification is calculated by dividing a pressure sensing width in the moving direction of the ink receiving medium in the above-described surface pressure measurement by the moving speed of the ink receiving medium. Hereinafter, this application time is referred to as a liquid absorbing nip time.

In this way, on the transfer body 101, the liquid component is absorbed from the first image and a second image with reduced liquid content is formed. The second image is then transferred onto the recording medium 108 at the transfer unit. Device configuration and conditions at the time of transfer will be described.

<Pressing Member for Transferring>

In the present embodiment, while the second image and the recording medium 108 conveyed by the conveyance device 107 for the recording medium are in contact with each other, the pressing member 106 for transferring presses the recording medium 108, and thereby an ink image is transferred onto the recording medium 108. When removing the liquid component contained in the first image on the transfer body 101, and then transferring it onto the recording medium 108, it is possible to obtain a recorded image in which curling, cockling and the like are suppressed.

The pressing member 106 is required to have a certain degree of structural strength from the viewpoint of conveying accuracy and durability of the recording medium 108. For the material of the pressing member 106, metal, ceramic, resin or the like is preferably used. Among them, in particular, in order to improve responsiveness of control by reducing inertia during operation in addition to rigidity and dimensional accuracy that can withstand pressurization at the time of transfer, aluminum, iron, stainless steel, acetal resin, epoxy resin, polyimide, polyethylene, polyethylene terephthalate, nylon, polyurethane, silica ceramics and alumina ceramics are preferably used. Further, these may be used in combination.

The pressing time of the pressing member 106 for transferring the second image on the transfer body 101 onto the recording medium 108 is not particularly limited, and in order not to impair the transferability and the durability of the transfer body, it is preferably 5 ms or more to 100 ms or less. In the present embodiment, the pressurizing time indicates the time during which the recording medium 108 and the transfer body 101 are in contact with each other, and the value of the time is calculated by performing the surface pressure measurement by using the surface pressure distribution measuring device (I-SCAN (product name), manufactured by NITTA Corporation), and dividing the length in the conveying direction of the pressure region by the conveying speed.

The pressure pressed by the pressing member 106 for transferring the second image on the transfer body 101 onto the recording medium 108 is also not particularly limited, but care is taken such that the transfer is performed well and the durability of the transfer body is not impaired. Therefore, it is preferable that the pressure is 9.8 $N/cm^2$ (1 $kgf/cm^2$) or more to 294.2 $N/cm^2$ (30 $kgf/cm^2$) or less. Incidentally, the pressure in the present embodiment indicates the nip pressure between the recording medium 108 and the transfer body 101, and the value of the pressure is calculated by performing the surface pressure measurement by the surface pressure distribution measuring device, and dividing the load in the pressure region by the area.

The temperature at which the pressing member 106 presses for transferring the second image on the transfer body 101 onto the recording medium 108 is also not particularly limited, and it is preferably equal to or higher than a glass transition point or equal to or higher than a softening point of a resin component contained in the ink. For heating, it is preferable to provide heating device for heating a second image on the transfer body 101, the transfer body 101 and the recording medium 108.

The shape of the pressing member 106 is not particularly limited, but for example, a roller shape can be mentioned.

<Recording Medium and Conveyance Device for Recording Medium>

In the present embodiment, the recording medium 108 is not particularly limited, and any of known recording media can be used. As the recording medium, a long object wound in a roll shape or a sheet material cut into a predetermined size can be exemplified. Examples of the materials include paper, a plastic film, a wood board, a cardboard and a metal film.

In FIG. 1, the conveyance device 107 for recording medium for conveying the recording medium 108 is constituted by a feeding roller 107*a* for recording medium and a winding roller 107*b* for recording medium, but it is not particularly limited thereto as long as the recording medium can be conveyed.

<Control System>

Figure 3:
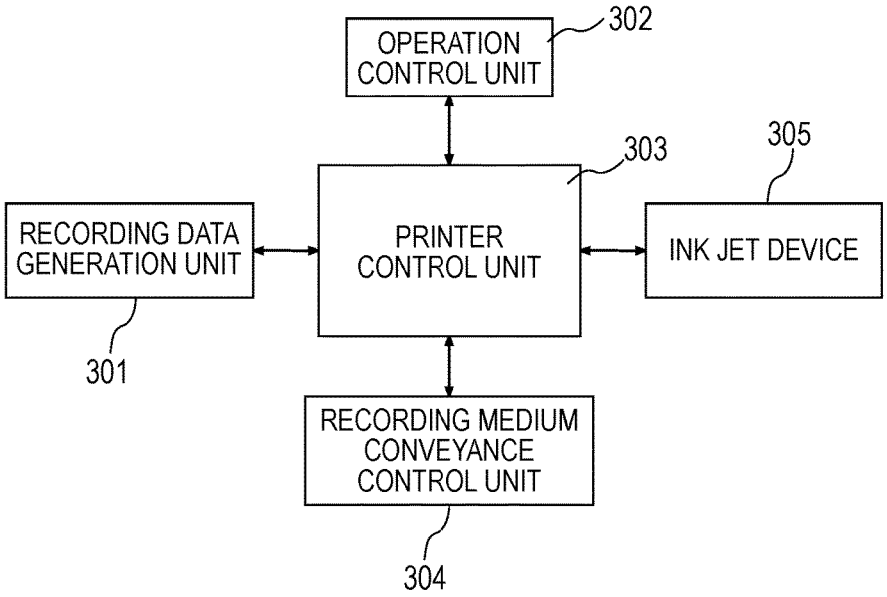
FIG. 3 is a block diagram illustrating a control system of the entire apparatus in the ink jet recording apparatus illustrated in FIGS. 1 and 2.

The transfer type ink jet recording apparatus in the present embodiment has a control system for controlling each device. FIG. 3 is a block diagram illustrating a control system of the entire apparatus in the transfer type ink jet recording apparatus illustrated in FIG. 1.

In FIG. 3, a reference numeral 301 represents a recording data generation unit such as an external print server, a reference numeral 302 represents an operation control unit such as an operation panel, a reference numeral 303 represents a printer control unit for executing a recording process, a reference numeral 304 represents a recording medium conveyance control unit for conveying the recording medium and a reference numeral 305 represents an ink jet device for printing.

Figure 4:
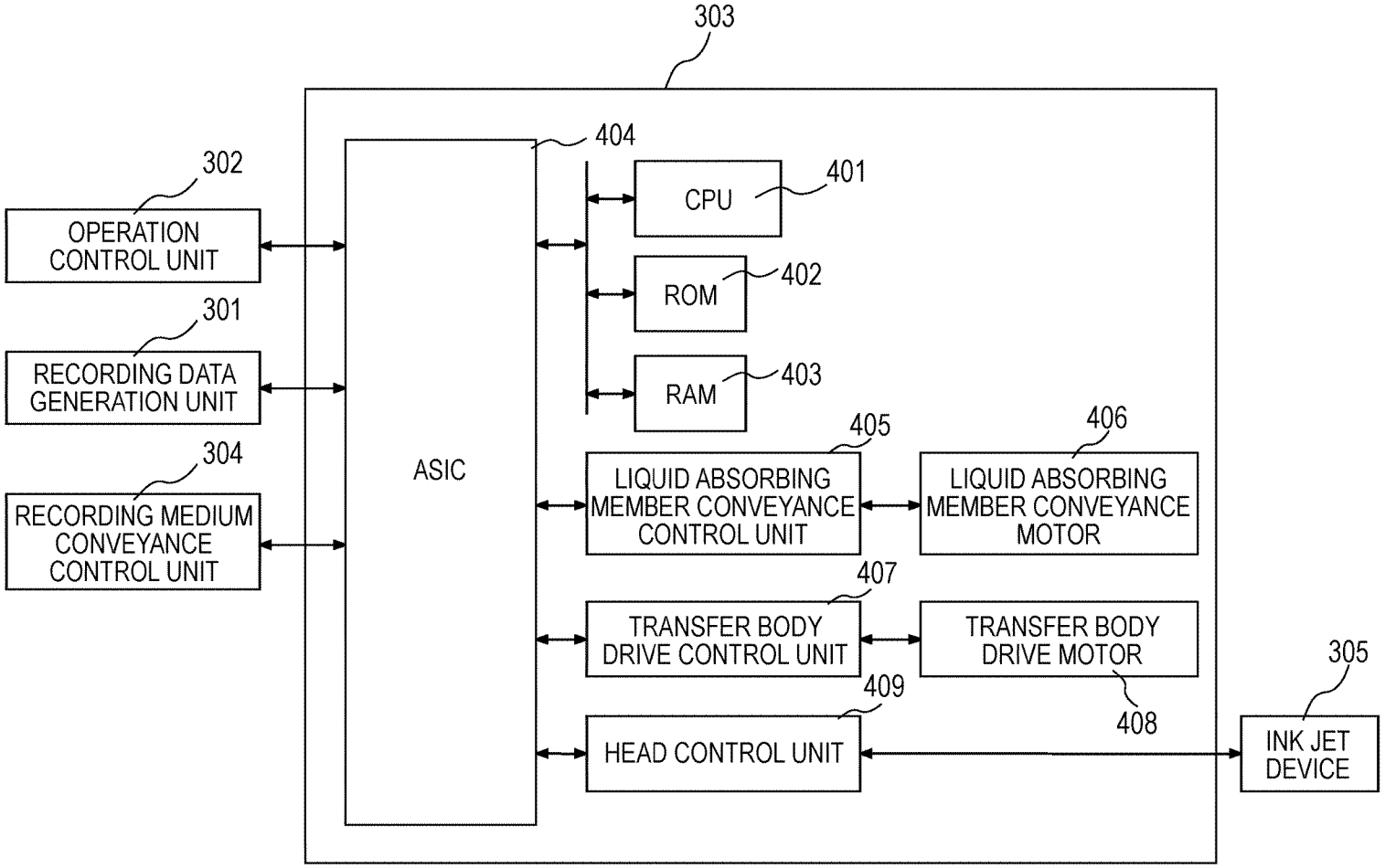
FIG. 4 is a block diagram of a printer control unit in the transfer type ink jet recording apparatus illustrated in FIG. 1.

FIG. 4 is a block diagram of a printer control unit in the transfer type ink jet recording apparatus illustrated in FIG. 1.

Reference numeral 401 represents a CPU for controlling the entire printer, a reference numeral 402 represents a ROM for storing a control program of the CPU and a reference numeral 403 represents a RAM for executing the program. A reference numeral 404 represents an application specific integrated circuit (ASIC) including a network controller, a serial IF controller, a controller for generating head data, a motor controller and the like. A reference numeral 405 represents a liquid absorbing member conveyance control unit for driving a liquid absorbing member conveyance motor 406, and the liquid absorbing member conveyance control unit 405 is controlled by a command from the ASIC 404 via the serial IF. A reference numeral 407 represents a transfer body drive control unit that drives a transfer body drive motor 408, and similarly, the transfer body drive control unit 407 is controlled by a command from the ASIC 404 via the serial IF. A reference numeral 409 represents a head control unit which performs final discharge data generation, drive voltage generation and the like of the ink jet device 305.

(Direct Drawing Type Ink Jet Recording Apparatus)

As another embodiment of the present invention, a direct drawing type ink jet recording apparatus can be mentioned. In the direct drawing type ink jet recording apparatus, the ink receiving medium is a recording medium on which an image is to be formed.

Figure 2:
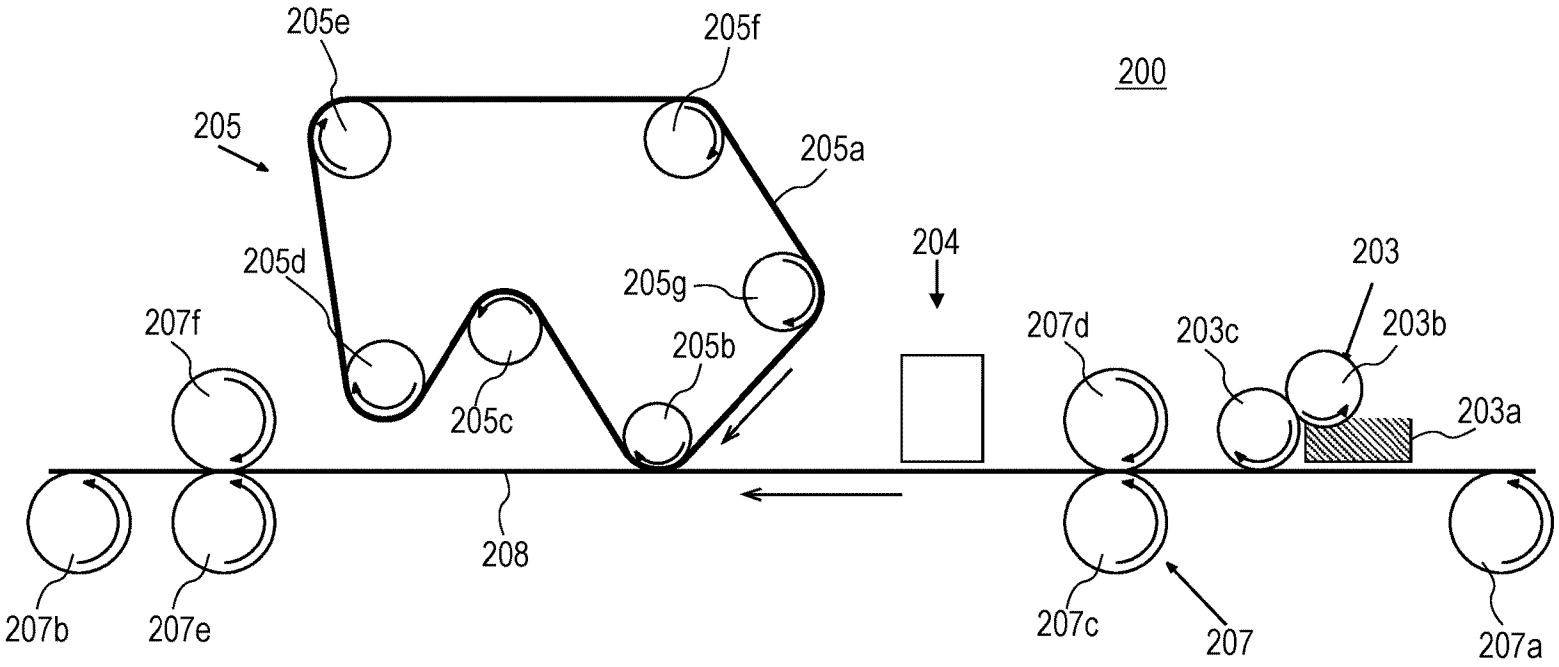
FIG. 2 is a schematic diagram illustrating one example of a configuration of a direct drawing type ink jet recording apparatus in one embodiment according to the present invention.

FIG. 2 is a schematic diagram illustrating one example of a schematic configuration of a direct drawing type ink jet recording apparatus 200 of the present embodiment. Compared to the transfer type ink jet recording apparatus described above, the direct drawing type ink jet recording apparatus has members similar to those of the transfer type ink jet recording apparatus except that it does not have the transfer body 101, the support member 102 and the cleaning member 109 for transfer body, and forms an image on a recording medium 208.

Therefore, a reaction liquid applying device 203 for applying the reaction liquid to the recording medium 208, an ink applying device 204 for applying ink to the recording medium 208 and a liquid absorbing device 205 that absorbs the liquid component contained in a first image by a liquid absorbing member 205*a* coming into contact with a first image on the recording medium 208 has the same configuration as that of the transfer type ink jet recording apparatus, and thus explanation thereof will not be described.

Note that, in the direct drawing type ink jet recording apparatus of the present embodiment, the liquid absorbing device 205 includes the liquid absorbing member 205*a* and a pressing member 205*b* for liquid absorption which presses the liquid absorbing member 205*a* against the first image on the recording medium 208. The shapes of the liquid absorbing member 205*a* and the pressing member 205*b* are not particularly limited, and it is possible to use the same shapes as the liquid absorbing member and the pressing member that can be used in the transfer type ink jet recording apparatus. In addition, the liquid absorbing device 205 may include an extending member for extending the liquid absorbing member. In FIG. 2, reference numerals 205*c*, 205*d*, 205*e*, 205*f* and 205*g* represent an extending roller as the extending member. The number of the extending rollers is not limited to five as illustrated in FIG. 4, and a necessary number of the extending rollers may be arranged according to the apparatus design. A recording medium support member (not shown) for supporting the recording medium from below may be provided at a position facing an ink applying unit for applying ink to the recording medium 208 by the ink applying device 204 and a liquid component removing unit for pressing the liquid absorbing member 205*a* against the first image on the recording medium to remove the liquid component.

<Conveyance Device for Recording Medium>

In the direct drawing type ink jet recording apparatus of the present embodiment, a conveyance device for recording medium 207 is not particularly limited, and a conveyance device in a known direct drawing type ink jet recording apparatus can be used. Examples thereof include, as illustrated in FIG. 2, a conveyance device for recording medium including a feeding roller 207*a* for recording medium, a winding roller 207*b* for recording medium and conveyance rollers 207*c*, 207*d*, 207*e* and 207*f* for recording medium.

<Control System>

The direct drawing type ink jet recording apparatus in the present embodiment has a control system for controlling each devices. The block diagram illustrating a control system of the entire apparatus in the direct drawing type ink jet recording apparatus illustrated in FIG. 2 is as illustrated in FIG. 3 similar to the transfer type ink jet recording apparatus illustrated in FIG. 1.

Figure 5:
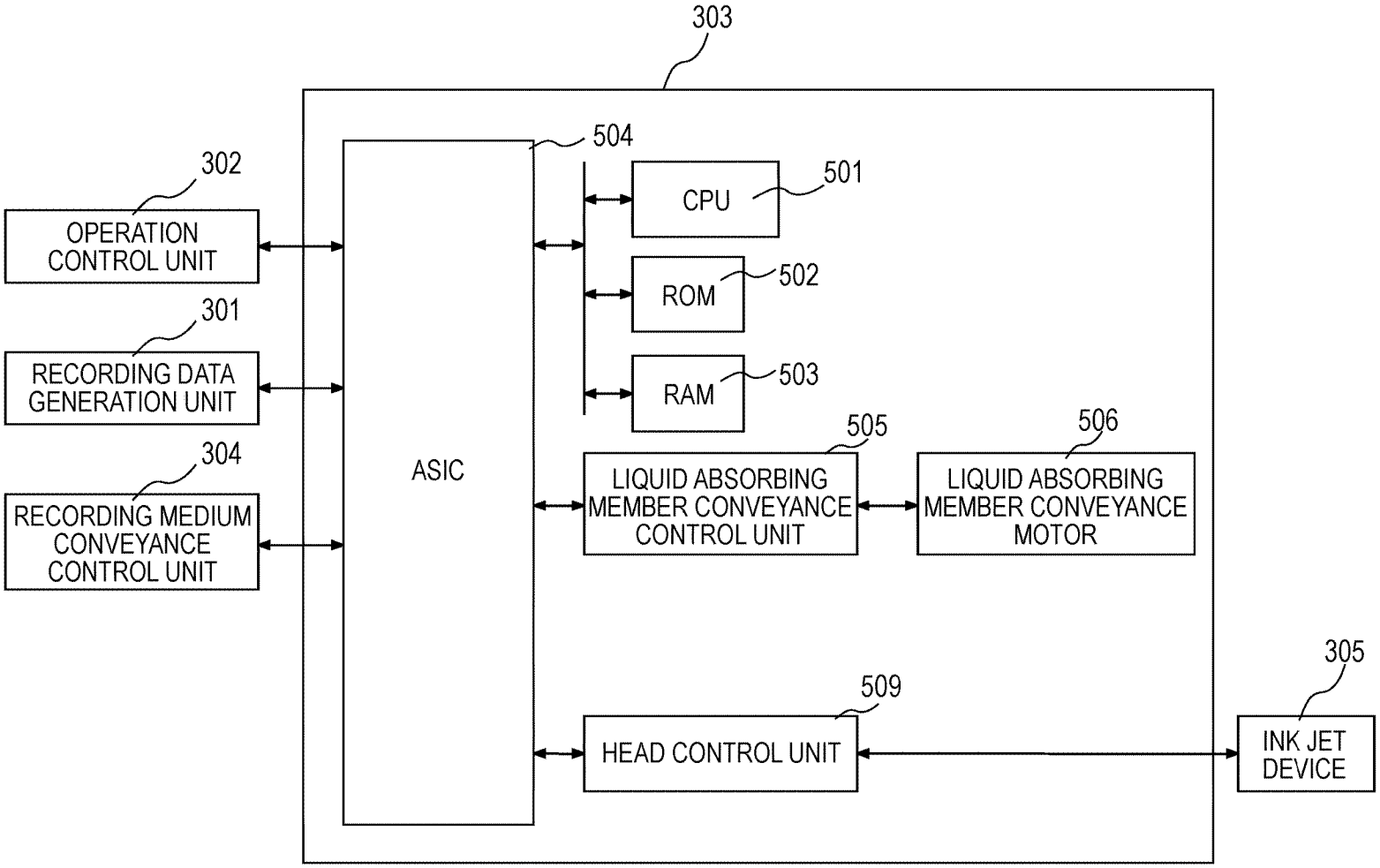
FIG. 5 is a block diagram of a printer control unit in the direct drawing type ink jet recording apparatus illustrated in FIG. 2.

FIG. 5 is a block diagram of a printer control unit in the direct drawing type ink jet recording apparatus illustrated in FIG. 2. Except for not including the transfer body drive control unit 407 and the transfer body drive motor 408, FIG. 5 is the same block diagram as the block diagram of the printer control unit in the transfer type ink jet recording apparatus in FIG. 4.

In other words, reference numeral 501 represents a CPU for controlling the entire printer, a reference numeral 502 represents a ROM for storing a control program of the CPU and a reference numeral 503 represents a RAM for executing the program. A reference numeral 504 represents an ASIC including a network controller, a serial IF controller, a controller for generating head data, a motor controller and the like. A reference numeral 505 represents a liquid absorbing member conveyance control unit for driving a liquid absorbing member conveyance motor 506, and the liquid absorbing member conveyance control unit 505 is controlled by a command from the ASIC 504 via the serial IF. A reference numeral 509 represents a head control unit which performs final discharge data generation, drive voltage generation and the like of the ink jet device 305.

EXAMPLES

Hereinafter, the present invention will be more specifically described with reference to examples and comparative examples. The present invention is not limited by the following examples without departing from the gist thereof. In the description of the following examples, "part" is on a mass basis unless otherwise specified.

<Preparing of Reaction Liquid>

For the reaction liquid, a reaction liquid having the composition indicated below was used. Note that, the "remainder" of the ion exchanged water is an amount such that the total of all components constituting the reaction liquid is 100.0% by mass.

Glutaric acid: 21.0% by mass

Glycerin: 5.0% by mass

Surfactant (Megafac F444 (product name), manufactured by DIC Corporation): 5.0% by mass Ion exchanged water: remainder <Preparing of Pigment Dispersion>

10 parts of carbon black (Monarch 1100 (product name), manufactured by Cabot Corporation), 15 parts of aqueous resin solution (obtained by neutralizing a styrene-ethyl acrylate-acrylic acid copolymer and an aqueous solution having an acid value of 150, a weight average molecular weight (Mw) of 8,000, and a resin content of 20.0% by mass with an aqueous potassium hydroxide solution), and 75 parts of pure water were mixed. The mixing liquid was charged into a batch type vertical sand mill (manufactured by AIMEX CO., Ltd.), the batch type vertical sand mill was filled with 200 parts of zirconia beads having a diameter of 0.3 mm, and a dispersion treatment was performed for five hours while cooling with water. When the dispersion was centrifuged to remove coarse particles, a pigment dispersion having a pigment content of 10.0% by mass was obtained.

<Preparing of Resin Fine Particle Dispersion>

20 parts of ethyl methacrylate, 3 parts of 2,2'-azobis-(2-methyl butyronitrile), and 2 parts of n-hexadecane were mixed and stirred for 0.5 hours. This mixture was added dropwise to 75 parts of an 8% by mass of aqueous solution of a styrene-butyl acrylate-acrylic acid copolymer (acid value: 130 mgKOH/g, weight average molecular weight (Mw): 7,000), and stirred for 0.5 hours. Next, ultrasonic waves were irradiated by an ultrasonic irradiator for three hours. Subsequently, a polymerization reaction was performed at 80° C. for four hours in a nitrogen atmosphere, and after cooling at room temperature, filtration was performed so as to prepare a resin fine particle dispersion having a resin content of 25.0% by mass.

<Preparing of Ink>

The pigment dispersion and the resin fine particle dispersion were mixed with each of the following components. Note that, the "remainder" of the ion exchanged water is an amount such that the total of all components constituting the ink is 100.0% by mass.

Pigment dispersion: 40.0% by mass

Resin fine particle dispersion: 20.0% by mass

Glycerin: 7.0% by mass

Polyethylene glycol (number average molecular weight (Mn): 1,000): 3.0% by mass

Surfactant: acetylenol E100 (product name, manufactured by Kawaken Fine Chemicals Co., Ltd.): 0.5% by mass Ion exchanged water: remainder After sufficiently stirring and dispersing the mixture, pressure filtration was performed with a microfilter (manufactured by FUJIFILM Corporation) having a pore diameter of 3.0 μm so as to prepare ink.

<Preparing Porous Body>

Each layer indicated in Table 1 was prepared as the first layer. The first layer is a porous body made of polytetrafluoroethylene (PTFE) having an average pore diameter of 0.2 μm on the side configured to be brought into contact with the first image, and is a multiaxially stretched film. For example, the first layer in Example 1 was prepared by a method of obtaining a porous body fibrillated by compression molding crystallized PTFE emulsion polymerized particles and biaxially stretching at a temperature equal to or lower than the melting point of PTFE. The softening temperature was measured from the peak value of the heat absorption amount obtained using a DSC measuring instrument (Q-1000 (product name), manufactured by TA Instruments.)

TABLE 1

| | First layer | | | |
|---|---|---|---|---|
| | Material | Young's modulus (GPa) | Softening temperature (° C.) | Thickness (μm) |
| Example 1 | PTFE | 0.5 | 327 | 4 |
| Example 2 | | | | 4 |
| Example 3 | | | | 10 |
| Example 4 | | | | 4 |
| Example 5 | | | | 4 |
| Comparative Example 1 | | | | 4 |
| Comparative Example 2 | | | | 4 |
| Comparative Example 3 | | | | 4 |
| Comparative Example 4 | | | | 4 |

Each layer indicated in Table 2 was prepared as the second layer. As the second layer in Examples 1 to 3, Example 5 and Comparative Examples 1 to 4, HOP series (product name, manufactured by Hirose Paper Mfg. Co., Ltd.) including a second fiber having a core structure made of polypropylene (PP) and a sheath structure made of polyethylene (PE) was used. Note that, the second layer in Example 5 includes the second layer a including the second fiber a, and the second layer b including the second fiber b. The average fiber diameter of the second fiber a is 5 μm, the average fiber diameter of the second fiber b is 15 μm, the second fiber a included in the second layer a disposed on the first layer side is set to be thinner, and the second fiber b included in the second layer b disposed on the third layer side is set to be thicker. As the second layer in Example 4, 15CN-70 (product name, manufactured by Hirose Paper Mfg. Co., Ltd.) including a second fiber having a core structure made of polyethylene terephthalate (PET) and a sheath structure made of copolymer polyethylene terephthalate (CO-PET) was used.

TABLE 2

| | | Second layer | | | | | | | | | |
|---|---|---|---|---|---|---|---|---|---|---|---|
| | | | | Core structure | | | | Sheath structure | | | |
| | | Average fiber diameter (μm) | Thickness (μm) | Average diameter of core (μm) | Material | Young's modulus (GPa) | Softening temperature (° C.) | Average thickness of sheath (μm) | Material | Young's modulus (GPa) | Softening temperature (° C.) |
| Example 1 | | 12 | 150 | 8 | PP | 1.5 | 160 | 2.0 | PE | 0.4 | 130 |
| Example 2 | | 15 | 170 | 10 | | | | 2.5 | | | |
| Example 3 | | 30 | 200 | 20 | | | | 5.0 | | | |
| Example 4 | | 13 | 210 | 8 | PET | 3.0 | 250 | 2.5 | CO-PET | — | 110 |
| Example 5 | Second layer a | 5 | 70 | 3 | PP | 1.5 | 160 | 1.0 | PE | 0.4 | 130 |
| | Second layer b | 15 | 170 | 10 | | | | 2.5 | | | |
| Comparative Example 1 | | 30 | 200 | 20 | | | | 5.0 | | | |
| Comparative Example 2 | | 5 | 70 | 3 | | | | 1.0 | | | |
| Comparative Example 3 | | 8 | 100 | 5 | | | | 1.5 | | | |
| Comparative Example 4 | | 8 | 100 | 5 | | | | 1.5 | | | |

Each layer indicated in Table 3 was prepared as the third layer. As the third layer in Examples 1 to 5 and Comparative Examples 1 to 3, a nonwoven fabric "PPS paper" (product name, manufactured by Hirose Paper Mfg. Co., Ltd.) prepared by wet-papermaking a polyphenylene sulfide (PPS) fiber "Torukon" (product name, manufactured by Toray Industries, Inc.) was used. As the third layer in Comparative Example 4, a nonwoven fabric formed by forming a polyethylene resin so as to satisfy the physical properties of Table 3 by a melt blown method was used.

TABLE 3

| | Third layer | | | | |
|---|---|---|---|---|---|
| | Material | Young's modulus (GPa) | Softening temperature (° C.) | Thickness (μm) | Average fiber diameter (μm) |
| Example 1 | PPS | 3.3 | ≥200 | 200 | 10 |
| Example 2 | | | | | |
| Example 3 | | | | | |
| Example 4 | | | | | |
| Example 5 | | | | | |
| Comparative Example 1 | | | | | |
| Comparative Example 2 | | | | | |
| Comparative Example 3 | | | | | |
| Comparative Example 4 | PE | 0.4 | 120 | | |

The first to third layers were welded by the laminator illustrated in FIG. 9. Specifically, after the first layer and the second layer were laminated, a third layer was further laminated so as to prepare a porous body. In each lamination step, the heating temperature was adjusted to be between 140° C. to 150° C.

<Ink Jet Recording Apparatus and Image Formation>

The transfer type ink jet recording apparatus illustrated in FIG. 1 was used. The transfer body 101 was fixed to the surface of the support member 102 by double-sided tape. A coated sheet obtained by coating a PET sheet having a thickness of 0.5 mm with silicone rubber (KE12 (product name), manufactured by Shin-Etsu Chemical Co., Ltd.) by a thickness of 0.3 mm was used as an elastic layer of the transfer body 101. Further, a mixture of a condensate obtained by mixing glycidoxypropyl triethoxy silane and methyl triethoxy silane at a molar ratio of 1:1 and heating it under reflux, and a photo cationic polymerization initiator (SP 150 (product name), manufactured by ADEKA) was prepared. An atmospheric pressure plasma treatment was performed on the elastic layer surface so that the contact angle of water on the surface of the elastic layer is 10 degrees or smaller. Thereafter, the mixture was applied onto the elastic layer, and the mixture was formed into a film by UV irradiation (high pressure mercury lamp, integrated exposure amount 5,000 mJ/cm$^2$) and thermal curing (150° C. for two hours) so as to form a transfer body 101 in which a surface layer having a thickness of 0.5 μm was formed on the elastic layer. Note that, the surface of the transfer body 101 was kept at 60° C. by heating device (not shown).

The applying amount of the reaction liquid applied by the reaction liquid applying device 103 was set to be 1 g/m$^2$. As the ink applying device 104, an ink jet recording head which discharges ink by an on-demand method using an electrothermal converter was used. The applying amount of the ink at the time of image formation was set to 20 g/m$^2$.

The liquid absorbing member 105*a* includes the porous body on the side to be in contact with the first image. The pressure is applied by the pressing member 105*b* so that the average nip pressure between the transfer body 101 and the liquid absorbing member 105*a* was set to be 2 kgf/cm$^2$. The diameter of the pressing member 105*b* was 200 mm.

The conveyance speed of the liquid absorbing member 105*a* was adjusted by extending rollers 105*c*, 105*d*, and 105*e* which extend and convey the liquid absorbing member 105*a* such that the speed was the same as the moving speed of the transfer body 101. Further, the recording medium 108 was conveyed by the feeding roller 107*a* for recording medium and the winding roller 107*b* for recording medium such that the conveyance speed of the recording medium 108 was the same as the moving speed of the transfer body 101. The conveyance speed of the recording medium 108 was set to be 0.2 m/s. As the recording medium 108, Aurora coated paper (product name, manufactured by Nippon Paper Industries Co., Ltd., basis weight 104 g/m$^2$) was used.

[Evaluation]

Evaluation of the ink jet recording apparatus obtained in examples and comparative examples was carried out by the following evaluation method. The evaluation results are indicated in Table 4. In the present invention, the evaluation criteria A and B of each of the evaluation items below were taken as preferable levels, and C and D were made unacceptable level.

<Collapse of Second Layer>

The cross section of the porous body was observed with a metallurgical microscope and SEM, and the collapse of the second layer was confirmed. Evaluation criteria are described below.

A: No collapse was confirmed.

B: Collapse was confirmed, which was acceptable.

C: Collapse was confirmed, which was unacceptable.

<Conveying Strength>

By applying a tension of 0.5 N per 1 mm of the width of the liquid absorbing member 105*a*, the liquid absorbing member 105*a* was conveyed and driven to check whether peeling occurred between the layers of the porous body. Evaluation criteria are described below.

A: No delamination occurred.

B: Delamination slightly occurred, which was acceptable.

C: Delamination occurred, which was unacceptable.

D: Elongation occurred in the liquid absorbing member 105*a* due to the tension, and the liquid absorbing member 105*a* could not be conveyed.

<Smeared Image>

In Examples and Comparative Examples which were A or B in the evaluation of the collapse of the second layer and the conveying strength, the amount of movement of the coloring material at an end of an image, that is, smeared image after absorbing the first liquid in the image formation was observed.

Evaluation criteria are described below.

A: Smeared image was not seen even after repeated use.

B: Smeared image was slightly observed, which was a degree which does not matter.

C: Smeared image was largely observed.

<Adhesion of Coloring Material>

In Examples which were A or B in the evaluation of the collapse of the second layer, the conveying strength and the smeared image, coloring material adhesion to the liquid absorbing member 105*a* after bringing the liquid absorbing member 105*a* into contact with the first image in the image formation was observed.

Evaluation criteria are described below.

A: No coloring material adhesion was observed.

B: Coloring material adhesion was slightly observed, which was a degree which does not matter.

C: Coloring material adhesion was frequently observed.

TABLE 4

| | Evaluation results | | | |
|---|---|---|---|---|
| | Collapse of second layer | Conveying strength | Smeared image | Adhesion of coloring material |
| Example 1 | A | B | A | B |
| Example 2 | A | A | A | B |
| Example 3 | A | B | A | B |
| Example 4 | A | A | A | B |
| Example 5 | A | A | A | A |
| Comparative Example 1 | A | A | C | — |
| Comparative Example 2 | A | C | — | — |
| Comparative Example 3 | A | C | — | — |
| Comparative Example 4 | B | D | — | — |

Regarding evaluation of collapse of the second layer, in all of Examples 1 to 5 and Comparative Examples 1 to 3, the second layer included the second fiber having the core-in-sheath structure, and a material having a high softening temperature was used for the first and third layers, and thereby collapse was not confirmed. On the other hand, in Comparative Example 4, since the third fiber made of PE was used as the third layer, when the sheath material (PE) of the second fiber was melted, the third layer was also melted, and it was easy for the material of the third layer to penetrate into the second layer, and thereby some collapses were confirmed. However, the collapse was acceptable.

Regarding the evaluation of the conveying strength, in Comparative Examples 2 and 3, peeling occurred between the second layer and the third layer. In Comparative Example 4, since the material of the third fiber in the third layer for securing the rigidity was PE, the liquid absorbing member 105*a* was remarkably elongated and plastically deformed at the stage of applying the conveying tension. As a result, it was not possible to convey the liquid absorbing member 105*a*.

Regarding the evaluation of the smeared image, when observing the cross section of the porous body of Comparative Example 1 with SEM, the PE which is the sheath material of the second fiber penetrates into the inside of the pores of the first layer so as to confirm that the pores of the first layer were blocked. With this, it is presumed that the smeared image occurred.

Regarding the evaluation of the coloring material adhesion, in Example 5, more excellent effects than those of Examples 1 to 4 were obtained. The reason for this is presumed that the average fiber diameter of the second fiber a is smaller than the average fiber diameter of the second fiber of Examples 1 to 4, and the irregularities of the surface of the first layer are suppressed.

Additionally, the same test was conducted by using the direct drawing type ink jet recording apparatus illustrated in FIG. 2. In the image formation by the direct drawing type ink jet recording apparatus illustrated in FIG. 2, Gloria Pure White paper (manufactured by Gojo Paper MFG. Co. Ltd, basis weight of 210 g/m$^2$) was used as a recording medium 208. The reaction liquid, the reaction liquid applying device 203, the ink, the ink applying device 204, the conveyance speed of the recording medium 208 and the liquid absorbing device 205, except for the recording medium 208, were similar to those of the transfer type ink jet recording apparatus in Example 1, and the same evaluation as that of Example 1 was carried out. As a result, it was confirmed that the same evaluation results as those of Example 1 can be obtained.

According to the present invention, it is possible to provide an ink jet recording apparatus including a liquid absorbing member having suppressed smeared image and high conveying strength, and a method of producing a porous body used in the ink jet recording apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet recording apparatus comprising:

an image forming unit that forms a first image containing a first liquid and a coloring material on an ink receiving medium; and a liquid absorbing member that includes a porous body, which is configured to be brought into contact with the first image so as to absorb at least a portion of the first liquid from the first image, wherein the porous body is a porous sheet in which a first layer, which is configured to be brought into contact with the first image, a second layer including a second fiber, and a third layer including a third fiber are laminated in this order, and the first layer, the second layer, and the third layer are porous layers, wherein an average fiber diameter of the second fiber is larger than an average fiber diameter of the third fiber, wherein the second fiber has a core-in-sheath structure including a core structure forming a central axis and a sheath structure surrounding the core structure, wherein a softening temperature of a material for forming the sheath structure is lower than any of a softening temperature of a material for forming the core structure, a softening temperature of a material for forming the first layer, and a softening temperature of a material for forming the third fiber, and wherein an average thickness of the sheath structure is smaller than a thickness of the first layer.

2. The ink jet recording apparatus according to claim 1, wherein Young's modulus of the material for forming the third fiber is higher than Young's modulus of the material for forming the first layer.

3. The ink jet recording apparatus according to claim 1, wherein an average pore diameter on a surface of the first layer which comes into contact with the first image is 0.2 μm or smaller.

4. The ink jet recording apparatus according to claim 1, wherein the first layer includes a fluororesin.

5. The ink jet recording apparatus according to claim 1, wherein the third fiber includes polyphenylene sulfide or polyimide.

6. The ink jet recording apparatus according to claim 1, wherein the image forming unit includes a device for applying a first liquid composition containing the first liquid or a second liquid, and an ink viscosity-increasing component onto the ink receiving medium, and a device for applying a second liquid composition containing the first liquid or a second liquid, and the coloring material onto the ink receiving medium, and wherein the first image is a mixture of the first and second liquid compositions and is viscously thickened more than either of the first and second liquid compositions.

7. The ink jet recording apparatus according to claim 1, wherein the ink receiving medium is a transfer body for temporarily holding the first image and a second image obtained by absorbing the first liquid from the first image, and wherein the apparatus further comprises:

a transfer unit including a pressing member for transferring the second image onto a recording medium on which an image is to be formed.

8. The ink jet recording apparatus according to claim 1, wherein the ink receiving medium is a recording medium on which an image is to be formed.

9. The ink jet recording apparatus according to claim 1, wherein the material for forming the core structure and the material for forming the sheath structure independently include polyolefin, polyamide, polyester, and polysulfone.

10. An ink jet recording apparatus comprising:

an image forming unit that forms a first image containing a first liquid and a coloring material on an ink receiving medium; and a liquid absorbing member that includes a porous body, which is configured to be brought into contact with the first image so as to absorb at least a portion of the first liquid from the first image, wherein the porous body is a porous sheet in which a first layer, which is configured to be brought into contact with the first image, a second layer a including a second fiber a, a second layer b including a second fiber b, and a third layer including a third fiber are laminated in this order, and the first layer, the second layer a, the second layer b, and the third layer are porous layers, wherein an average fiber diameter of the second fiber b is larger than an average fiber diameter of the third fiber, wherein the second fiber a and the second fiber b have a core-in-sheath structure including a core structure forming a central axis and a sheath structure surrounding the core structure, wherein a softening temperature of a material for forming the sheath structure of the second fiber a is lower than any of a softening temperature of a material for forming the core structure of the second fiber a and a softening temperature of a material for forming the first layer, wherein a softening temperature of a material for forming the sheath structure of the second fiber b is lower than any of a softening temperature of a material for forming the core structure of the second fiber b and a softening temperature of a material for forming the third fiber, and wherein an average thickness of the sheath structure of the second fiber a is smaller than a thickness of the first layer.

11. The ink jet recording apparatus according to claim 10, wherein Young's modulus of the material for forming the third fiber is higher than Young's modulus of the material for forming the first layer.

12. The ink jet recording apparatus according to claim 10, wherein an average pore diameter on a surface of the first layer which comes into contact with the first image is 0.2 μm or smaller.

13. The ink jet recording apparatus according to claim 10, wherein the first layer includes a fluororesin.

14. The ink jet recording apparatus according to claim 10, wherein the third fiber includes polyphenylene sulfide or polyimide.

15. The ink jet recording apparatus according to claim 10, wherein the image forming unit includes a device for applying a first liquid composition containing the first liquid or a second liquid, and an ink viscosity-increasing component onto the ink receiving medium, and a device for applying a second liquid composition containing the first liquid or a second liquid, and the coloring material onto the ink receiving medium, and wherein the first image is a mixture of the first and second liquid compositions and is viscously thickened more than either of the first and second liquid compositions.

16. The ink jet recording apparatus according to claim 10, wherein the ink receiving medium is a transfer body for temporarily holding the first image and a second image obtained by absorbing the first liquid from the first image, and wherein the apparatus further comprises:

a transfer unit including a pressing member for transferring the second image onto a recording medium on which an image is to be formed.

17. The ink jet recording apparatus according to claim 10, wherein the ink receiving medium is a recording medium on which an image is to be formed.

18. The ink jet recording apparatus according to claim 10, wherein the material for forming the core structure and the material for forming the sheath structure independently include polyolefin, polyamide, polyester, and polysulfone.

19. An ink jet recording apparatus comprising:

an image forming unit that forms a first image on an ink receiving medium by applying ink containing a first liquid and a coloring material; and a liquid absorbing member that includes a porous body, which is configured to be brought into contact with the first image so as to concentrate ink constituting the first image, wherein the porous body is a porous sheet in which a first layer, which is configured to be brought into contact with the first image, a second layer including a second fiber, and a third layer including a third fiber are laminated in this order, and the first layer, the second layer, and the third layer are porous layers, wherein an average fiber diameter of the second fiber is larger than an average fiber diameter of the third fiber, wherein the second fiber has a core-in-sheath structure including a core structure forming a central axis and a sheath structure surrounding the core structure, wherein a softening temperature of a material for forming the sheath structure is lower than any of a softening temperature of a material for forming the core structure, a softening temperature of a material for forming the first layer, and a softening temperature of a material for forming the third fiber, and wherein an average thickness of the sheath structure is smaller than a thickness of the first layer.

20. A method of producing a porous body used in an ink jet recording apparatus including: an image forming unit that forms a first image containing a first liquid and a coloring material on an ink receiving medium; and a liquid absorbing member that includes a porous body, which is configured to be brought into contact with the first image so as to absorb at least a portion of the first liquid from the first image, the method comprising:

a step of heating a first layer, which is configured to be brought into contact with the first image, a second layer including a second fiber, and a third layer including a third fiber in a state of being laminated in this order so as to form a porous body including the first layer, the second layer, and the third layer, wherein the first layer, the second layer, and the third layer are porous layers, wherein an average fiber diameter of the second fiber is larger than an average fiber diameter of the third fiber, wherein the second fiber has a core-in-sheath structure including a core structure forming a central axis and a sheath structure surrounding the core structure, wherein a softening temperature of a material for forming the sheath structure is lower than any of a softening temperature of a material for forming the core structure, a softening temperature of a material for forming the first layer, and a softening temperature of a material for forming the third fiber, wherein an average thickness of the sheath structure is smaller than a thickness of the first layer, and wherein a temperature of the heating is equal to or higher than the softening temperature of the material for forming the sheath structure, and is equal to or lower than the softening temperature of the material for forming the core structure, the softening temperature of the material for forming the first layer, and the softening temperature of the material for forming the third fiber.

21. A method of producing a porous body used in an ink jet recording apparatus including: an image forming unit that forms a first image containing a first liquid and a coloring material on an ink receiving medium; and a liquid absorbing member that includes a porous body, which is configured to be brought into contact with the first image so as to absorb at least a portion of the first liquid from the first image, the method comprising:

a step of heating a first layer, which is configured to be brought into contact with the first image, a second layer a including a second fiber a, a second layer b including a second fiber b, and a third layer including a third fiber in a state of being laminated in this order so as to form a porous body including the first layer, the second layer a, the second layer b, and the third layer, wherein the first layer, the second layer a, the second layer b, and the third layer are porous layers, wherein an average fiber diameter of the second fiber b is larger than an average fiber diameter of the third fiber, wherein the second fiber a and the second fiber b have a core-in-sheath structure including a core structure forming a central axis and a sheath structure surrounding the core structure, wherein a softening temperature of a material for forming the sheath structure of the second fiber a is lower than any of a softening temperature of a material for forming the core structure of the second fiber a and a softening temperature of a material for forming the first layer, wherein a softening temperature of a material for forming the sheath structure of the second fiber b is lower than any of a softening temperature of a material for forming the core structure of the second fiber b and a softening temperature of a material for forming the third fiber, wherein an average thickness of the sheath structure of the second fiber a is smaller than a thickness of the first layer, and wherein a temperature of the heating is equal to or higher than the softening temperature of the material for forming the sheath structure of the second fiber a and the second fiber b, and is equal to or lower than the softening temperature of the material for forming the core structure of the second fiber a and the second fiber b, the softening temperature of the material for forming the first layer, and the softening temperature of the material for forming the third fiber.

22. A porous body comprising, in stated order:

a first layer; and a second layer including a second fiber, wherein the first layer and the second layer are porous layers, wherein the second fiber has a core-in-sheath structure including a core structure forming a central axis and a sheath structure surrounding the core structure, wherein a softening temperature of a material for forming the sheath structure is lower than any of a softening temperature of a material for forming the core structure and a softening temperature of a material for forming the first layer, and wherein an average thickness of the sheath structure is smaller than a thickness of the first layer.

23. The porous body according to claim 22, which comprises, in stated order:

the first layer;

the second layer; and a third layer including a third fiber, wherein the third layer is a porous layer.

24. The porous body according to claim 23, wherein an average fiber diameter of the second fiber is larger than an average fiber diameter of the third fiber.

25. The porous body according to claim 23, wherein the softening temperature of the material for forming the sheath structure is lower than a softening temperature of a material for forming the third fiber.

26. A porous body comprising, in stated order:

a first layer;

a second layer a including a second fiber a; and a second layer b including a second fiber b, wherein the first layer, the second layer a, and the second layer b are porous layers, wherein the second fiber a and the second fiber b have a core-in-sheath structure including a core structure forming a central axis and a sheath structure surrounding the core structure, wherein a softening temperature of a material for forming the sheath structure of the second fiber a is lower than any of a softening temperature of a material for forming the core structure of the second fiber a and a softening temperature of a material for forming the first layer, wherein a softening temperature of a material for forming the sheath structure of the second fiber b is lower than a softening temperature of a material for forming the core structure of the second fiber b, and wherein an average thickness of the sheath structure is smaller than a thickness of the first layer.

27. The porous body according to claim 26, which comprises, in stated order:

the first layer;

the second layer a;

the second layer b; and a third layer including a third fiber, wherein the third layer is a porous layer.

28. The porous body according to claim 27, wherein an average fiber diameter of the second fiber b is larger than an average fiber diameter of the third fiber.

29. The porous body according to claim 27, wherein the softening temperature of the material for forming the sheath structure of the second fiber b is lower than a softening temperature of a material for forming the third fiber.

* * * * *